US008376028B2

(12) United States Patent
Miki et al.

(10) Patent No.: US 8,376,028 B2
(45) Date of Patent: Feb. 19, 2013

(54) STEEL CONTINUOUS CASTING METHOD

(75) Inventors: Yuji Miki, Tokyo (JP); Yasuo Kishimoto, Tokyo (JP)

(73) Assignee: JFE Steel Corporation, Chiyoda-ku, Tokyo (JP)

( * ) Notice: Subject to any disclaimer, the term of this patent is extended or adjusted under 35 U.S.C. 154(b) by 0 days.

(21) Appl. No.: 13/508,920

(22) PCT Filed: Mar. 9, 2010

(86) PCT No.: PCT/JP2010/054280

§ 371 (c)(1),
(2), (4) Date: May 9, 2012

(87) PCT Pub. No.: WO2011/058769

PCT Pub. Date: May 19, 2011

(65) Prior Publication Data

US 2012/0227924 A1 Sep. 13, 2012

(30) Foreign Application Priority Data

Nov. 10, 2009 (JP) ..... 2009-256717
Mar. 7, 2010 (JP) ..... 2010-049973

(51) Int. Cl.
*B22D 11/041* (2006.01)
*B22D 11/115* (2006.01)

(52) U.S. Cl. ..... 164/466; 164/468

(58) Field of Classification Search ..... 164/466, 164/468

See application file for complete search history.

(56) References Cited

FOREIGN PATENT DOCUMENTS

| | | | |
|---|---|---|---|
| JP | 3142049 | A | 6/1991 |
| JP | 10305353 | A | 11/1998 |
| JP | 2002001501 | A | 1/2002 |
| JP | 2005152954 | A | 6/2005 |
| JP | 2008200732 | A | 9/2008 |

OTHER PUBLICATIONS

International Search Report dated Jun. 15, 2010, application No. PCT/JP2010/054280.

*Primary Examiner* — Kuang Lin
(74) *Attorney, Agent, or Firm* — RatnerPrestia

(57) ABSTRACT

A steel continuous casting method using a continuous caster that includes a pair of upper magnetic poles and a pair of lower magnetic poles is disclosed. The method comprises braking a molten steel flow with the DC magnetic fields respectively applied to the pair of upper magnetic poles and the pair of lower magnetic poles while stirring a molten steel with an AC magnetic field simultaneously applied to the pair of upper magnetic poles, the strength of an AC magnetic field applied to the upper magnetic poles is set within the range of 0.060 to 0.090 T and the strengths of DC magnetic fields applied to the upper and lower magnetic poles are controlled within particular ranges in accordance with the width of the slab to be cast and the casting speed.

10 Claims, 5 Drawing Sheets

STEEL CONTINUOUS CASTING METHOD

CROSS REFERENCE TO RELATED APPLICATIONS

This application is the U.S. National Phase application of PCT International Application No. PCT/JP2010/054280, filed Mar. 9, 2010, and claims priority to Japanese Patent Application Nos. 2009-256717, filed Nov. 10, 2009, and 2010-049973, filed Mar. 7, 2010, the disclosure of both are incorporated herein by reference in their entireties for all purposes.

FIELD OF THE INVENTION

The present invention relates to a continuous casting method for producing a slab by casting molten steel while controlling a molten steel flow in a mold by electromagnetic force.

BACKGROUND OF THE INVENTION

In continuous casting of steel, molten steel placed in a tundish is poured into a mold for continuous casting via an immersion nozzle connected to the tundish bottom. In this case, the molten steel flow discharged from a spout of the immersion nozzle to inside a mold is accompanied with non-metallic inclusions (mainly, deoxidization products such as alumina) and bubbles of inert gas (inert gas injected to prevent nozzle clogging caused by adhesion and accretion of alumina and the like) injected from an inner wall surface of an upper nozzle. However, when the non-metallic inclusions and bubbles are entrapped in a solidification shell, product defects (defects originating in inclusions and bubbles) occur. Furthermore, a mold flux (mold powder) is entrained in a molten steel upward flow reaching a meniscus and also becomes trapped in the solidification shell, resulting in product defects.

It has been a conventional practice to apply magnetic fields to the molten steel flow in a mold to control the flow of the molten steel through electromagnetic force of the magnetic fields in order to prevent non-metallic inclusions, mold flux, and bubbles in molten steel from becoming entrapped in a solidification shell and forming product defects. Many proposals have been made regarding this technique.

For example, patent document 1 discloses a method for controlling a molten steel flow by DC magnetic fields respectively applied to a pair of upper magnetic poles and a pair of lower magnetic poles that face each other with a mold long-side portion therebetween. According to this method, a molten flow is divided into an upward flow and a downward flow after discharged from a spout of an immersion nozzle, the downward flow is braked with a DC magnetic field in the lower portion, and the upward flow is braked with a DC magnetic field in the upper portion so as to prevent the non-metallic inclusions and mold flux accompanying the molten steel flow from becoming trapped in a solidification shell.

Patent document 2 discloses a method with which a pair of upper magnetic poles and a pair of lower magnetic poles are provided to face each other with a mold long side portion therebetween as in patent document 1 and magnetic fields are applied using these poles where (1) a DC magnetic field and an AC magnetic field are simultaneously applied to at least the lower magnetic poles or (2) a DC magnetic field and an AC magnetic field are simultaneously applied to the upper magnetic poles and a DC magnetic field is applied to the lower magnetic poles. According to this method, the molten steel flow is braked with the DC magnetic field as in patent document 1 while the molten steel is stirred with the AC magnetic field so as to achieve an effect of cleaning non-metallic inclusions and the like at the solidification shell interface.

Patent document 3 discloses a method for braking a molten steel flow by using DC magnetic fields respectively applied to a pair of upper magnetic poles and a pair of lower magnetic poles facing each other with a mold long side portion therebetween and by optionally simultaneously applying an AC magnetic field to the upper magnetic poles, in which the strengths of the DC magnetic fields, the ratio of the strength of the DC magnetic field of the upper electrodes to that of the lower electrodes, and the strength of (the upper AC magnetic field, optionally) are controlled within particular numeric ranges. Patent document 4 discloses a technique of producing a continuously cast slab having a graded composition in which the concentration of a particular solute element is higher in a surface layer portion than in the interior of the slab. According to this technique, a DC magnetic field is applied in a direction intersecting the thickness of the slab by using magnetic poles disposed at two stages, i.e., upper and lower stages, so as to increase the concentration of the solute element in the molten steel in an upper pool while a shifting AC magnetic field is simultaneously applied with the DC magnetic field during magnetic field application in an upper portion. However, according to the technique disclosed in patent document 4, the shifting AC magnetic field is applied to induce a flow that eliminates local nonuniformity of the solute concentration.

PATENT DOCUMENT

Patent document 1: Japanese Unexamined Patent Application Publication No. 3-142049

Patent document 2: Japanese Unexamined Patent Application Publication No. 10-305353

Patent document 3: Japanese Unexamined Patent Application Publication No. 2008-200732

Patent document 4: Japanese Unexamined Patent Application Publication No. 2002-1501

SUMMARY OF THE INVENTION

Due to the increased stringency in quality requirement for steel sheets for automotive outer panels, the defects related to fine bubbles and entrainment of mold flux which have not been regarded as a problem previously are now increasingly regarded as problematic. Conventional continuous casting methods such as those of the related art described above cannot satisfactorily meet such a stringent quality requirement. In particular, a galvannealed steel sheet is heated after hot-dipping to diffuse the iron component of the base steel sheet into a zinc coating layer and the surface properties of the base steel sheet greatly affect the quality of the galvannealed steel sheet. In other words, when the surface layer of a base steel sheet has defects related to bubbles and flux, the thickness of a coating layer becomes uneven irrespective of how small the defects are, and the unevenness appears as band-like defects in the surface, thereby rendering the steel sheet unsuitable for usage, such as automotive outer panels, where the quality requirement is stringent.

Aspects of the present invention address the aforementioned problems of the related art and provide a continuous casting method with which a high-quality slab having not only few defects originating from non-metallic inclusions and mold flux which have conventionally been regarded as problems but also few defects caused by entrapment of fine bubbles and mold flux. Note that aspects of the present invention do not basically encompass slabs having graded compositions such as those described in patent document 4. This is because the number of flux defects will increase when a solute element whose concentration is to be graded is added through wires, for example, and this is not suitable for production of a steel sheet required to satisfy stringent surface quality.

The inventors have studied various casting conditions for controlling a molten steel flow in a mold using electromagnetic force to address the problems described above. As a result, the following has been found regarding a method for continuously casting a steel in which a molten steel flow is braked with DC magnetic fields respectively applied to a pair of upper magnetic poles and a pair of lower magnetic poles that face each other with a mold long side portion therebetween while a molten steel is stirred with an AC magnetic field simultaneously applied to the upper magnetic poles. A high-quality slab that has not only few defects caused by non-metallic inclusions and mold flux which have conventionally been regarded as problems but also few defects caused by fine bubbles and mold flux can be obtained by optimizing the strengths of the DC magnetic fields respectively applied to the upper magnetic poles and the lower magnetic poles and the strength of the AC magnetic field simultaneously applied to the upper magnetic poles in accordance with the width of a slab to be cast and the casting speed. In optimizing the magnetic field strengths, the strength of the AC magnetic field simultaneously applied to the upper magnetic poles is set to a predetermined high level and the strengths of the DC magnetic fields respectively applied to the upper magnetic poles and the lower magnetic poles are controlled to obtain a high-quality slab with few defects. In addition, the system for controlling the AC magnetic field is no longer necessary since the upper AC magnetic field strength (current value) is set to be constant. Thus, the control system for the magnetic field generator can be simplified and the facility cost can be significantly reduced.

The reason why a high-quality slab with few defects related to bubbles and mold flux is obtained by optimization of the casting conditions described above has also been thoroughly studied. As a result, it has been found that the turbulence energy on top surface (involved in generation of a vortex near the surface), a flow velocity of molten steel at the molten steel-solidification shell interface, and a flow velocity on top surface are the factors (primary factors) involved in generation of bubble defects and flux defects, and the optimization of the casting conditions adequately controls the molten steel flow in the mold through these factors, thereby achieving a state in which entrapment of bubbles at the solidification interface and entrainment of mold flux are suppressed. Moreover, it has also been found that by optimizing the amount of inert gas injected from the inner wall of the immersion nozzle and the thickness of the slab to be cast, another factor called a bubble concentration at solidification interface is adequately controlled and the number of bubble defects can be further reduced.

Aspects of the present invention have been made on the basis of these findings and is summarized as follows.

[1] A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously (superimposingly) applied to the pair of upper magnetic poles, characterized in that the immersion nozzle is used at an immersion depth (distance from a meniscus to an upper end of the molten steel spout) of 180 mm or more and less than 240 mm, a strength of the AC magnetic field applied to the upper magnetic poles is set to 0.060 to 0.090 T, a strength of a DC magnetic field applied to the upper magnetic poles is set to 0.02 to 0.18 T, a strength of a DC magnetic field applied to the lower magnetic poles is set to 0.30 to 0.45 T, and continuous casting is conducted at casting speeds (a) to (d) below in accordance with slab width:

(a) When a slab width is 950 mm or more and less than 1050 mm, the casting speed is 0.95 m/min or more and less than 1.65 m/min.

(b) When a slab width is 1050 mm or more and less than 1250 mm, the casting speed is 0.95 m/min or more and less than 1.45 m/min.

(c) When a slab width is 1250 mm or more and less than 1450 mm, the casting speed is 0.95 m/min or more and less than 1.25 m/min.

(d) When a slab width is 1450 mm or more and less than 1750 mm, the casting speed is 0.95 m/min or more and less than 1.05 m/min.

[2] A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, characterized in that the immersion nozzle is used at an immersion depth (distance from a meniscus to an upper end of the molten steel spout) of 180 mm or more and less than 240 mm, a strength of the AC magnetic field applied to the upper magnetic poles is set to 0.060 to 0.090 T, a strength of a DC magnetic field applied to the upper magnetic poles is set to more than 0.18 T and 0.25 T or less, a strength of a DC magnetic field applied to the lower magnetic poles is set to 0.30 to 0.45 T, and continuous casting is conducted at casting speeds (a) to (e) below in accordance with slab width:

(a) When a slab width is 1050 mm or more and less than 1150 mm, the casting speed is 1.45 m/min or more and less than 2.25 m/min.

(b) When a slab width is 1150 mm or more and less than 1250 mm, the casting speed is 1.45 m/min or more and less than 2.05 m/min.

(c) When a slab width is 1250 mm or more and less than 1350 mm, the casting speed is 1.25 m/min or more and less than 2.05 m/min.

(d) When a slab width is 1350 mm or more and less than 1450 mm, the casting speed is 1.25 m/min or more and less than 1.85 m/min.

(e) When a slab width is 1450 mm or more and less than 1750 mm, the casting speed is 1.05 m/min or more and less than 1.65 m/min.

[3] A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, characterized in that the immersion nozzle is used at an immersion depth (distance from a meniscus to an upper end of the molten steel spout) of 180 mm or more and less than 240 mm, a strength of the AC magnetic field applied to the upper magnetic poles is set to 0.060 to 0.090 T, a strength of a DC magnetic field applied to the upper magnetic poles is set to more than 0.25 T and 0.35 T or less, a strength of a DC magnetic field applied to the lower magnetic poles is set to 0.30 to 0.45 T, and continuous casting is conducted at casting speeds (a) to (f) below in accordance with slab width:

(a) When a slab width is 1050 mm or more and less than 1150 mm, the casting speed is 2.25 m/min or more and less than 2.65 m/min.

(b) When a slab width is 1150 mm or more and less than 1350 mm, the casting speed is 2.05 m/min or more and less than 2.65 m/min.

(c) When a slab width is 1350 mm or more and less than 1450 mm, the casting speed is 1.85 m/min or more and less than 2.45 m/min.

(d) When a slab width is 1450 mm or more and less than 1550 mm, the casting speed is 1.65 m/min or more and less than 2.35 m/min.

(e) When a slab width is 1550 mm or more and less than 1650 mm, the casting speed is 1.65 m/min or more and less than 2.25 m/min.

(f) When a slab width is 1650 mm or more and less than 1750 mm, the casting speed is 1.65 m/min or more and less than 2.15 m/min.

[4] A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, characterized in that the immersion nozzle is used at an immersion depth (distance from a meniscus to an upper end of the molten steel spout) of 240 mm or more and less than 270 mm, a strength of the AC magnetic field applied to the upper magnetic poles is set to 0.060 to 0.090 T, a strength of a DC magnetic field applied to the upper magnetic poles is set to 0.02 to 0.18 T, a strength of a DC magnetic field applied to the lower magnetic poles is set to 0.30 to 0.45 T, and continuous casting is conducted at casting speeds (a) to (d) below in accordance with slab width:

(a) When a slab width is 950 mm or more and less than 1050 mm, the casting speed is 0.95 m/min or more and less than 1.65 m/min.

(b) When a slab width is 1050 mm or more and less than 1250 mm, the casting speed is 0.95 m/min or more and less than 1.45 m/min.

(c) When a slab width is 1250 mm or more and less than 1450 mm, the casting speed is 0.95 m/min or more and less than 1.25 m/min.

(d) When a slab width is 1450 mm or more and less than 1750 mm, the casting speed is 0.95 m/min or more and less than 1.05 m/min.

[5] A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, characterized in that the immersion nozzle is used at an immersion depth (distance from a meniscus to an upper end of the molten steel spout) of 240 mm or more and less than 270 mm, a strength of the AC magnetic field applied to the upper magnetic poles is set to 0.060 to 0.090 T, a strength of a DC magnetic field applied to the upper magnetic poles is set to more than 0.18 T and 0.25 T or less, a strength of a DC magnetic field applied to the lower magnetic poles is set to 0.30 to 0.45 T, and continuous casting is conducted at casting speeds (a) to (f) below in accordance with slab width:

(a) When a slab width is 1050 mm or more and less than 1150 mm, the casting speed is 1.45 m/min or more and less than 2.45 m/min.

(b) When a slab width is 1150 mm or more and less than 1250 mm, the casting speed is 1.45 m/min or more and less than 2.25 m/min.

(c) When a slab width is 1250 mm or more and less than 1350 mm, the casting speed is 1.25 m/min or more and less than 2.05 m/min.

(d) When a slab width is 1350 mm or more and less than 1450 mm, the casting speed is 1.25 m/min or more and less than 1.85 m/min.

(e) When a slab width is 1450 mm or more and less than 1550 mm, the casting speed is 1.05 m/min or more and less than 1.85 m/min.

(f) When a slab width is 1550 mm or more and less than 1750 mm, the casting speed is 1.05 m/min or more and less than 1.65 m/min.

[6] A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, characterized in that the immersion nozzle is used at an immersion depth (distance from a meniscus to an upper end of the molten steel spout) of 240 mm or more and less than 270 mm, a strength of the AC magnetic field applied to the upper magnetic poles is set to 0.060 to 0.090 T, a strength of a DC magnetic field applied to the upper magnetic poles is set to more than 0.25 T and 0.35 T or less, a strength of a DC magnetic field applied to the lower magnetic poles is set to 0.30 to 0.45 T, and continuous casting is conducted at casting speeds (a) to (g) below in accordance with slab width:

(a) When a slab width is 1050 mm or more and less than 1150 mm, the casting speed is 2.45 m/min or more and less than 2.65 m/min.

(b) When a slab width is 1150 mm or more and less than 1250 mm, the casting speed is 2.25 m/min or more and less than 2.65 m/min.

(c) When a slab width is 1250 mm or more and less than 1350 mm, the casting speed is 2.05 m/min or more and less than 2.65 m/min.

(d) When a slab width is 1350 mm or more and less than 1450 mm, the casting speed is 1.85 m/min or more and less than 2.45 m/min.

(e) When a slab width is 1450 mm or more and less than 1550 mm, the casting speed is 1.85 m/min or more and less than 2.35 m/min.

(f) When a slab width is 1550 mm or more and less than 1650 mm, the casting speed is 1.65 m/min or more and less than 2.25 m/min.

(g) When a slab width is 1650 mm or more and less than 1750 mm, the casting speed is 1.65 m/min or more and less than 2.15 m/min.

[7] A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, characterized in that the immersion nozzle is used at an immersion depth (distance from a meniscus to an upper end of the molten steel spout) of 270 mm or more and less than 300 mm, a strength of the AC magnetic field applied to the upper magnetic poles is set to 0.060 to 0.090 T, a strength of a DC magnetic field applied to the upper magnetic poles is set to 0.02 to 0.18 T, a strength of a DC magnetic field applied to the lower magnetic poles is set to 0.30 to 0.45 T, and continuous casting is conducted at casting speeds (a) to (d) below in accordance with slab width:

(a) When a slab width is 950 mm or more and less than 1050 mm, the casting speed is 0.95 m/min or more and less than 1.65 m/min.

(b) When a slab width is 1050 mm or more and less than 1250 mm, the casting speed is 0.95 m/min or more and less than 1.45 m/min.

(c) When a slab width is 1250 mm or more and less than 1450 mm, the casting speed is 0.95 m/min or more and less than 1.25 m/min.

(d) When a slab width is 1450 mm or more and less than 1750 mm, the casting speed is 0.95 m/min or more and less than 1.05 m/min.

[8] A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, characterized in that the immersion nozzle is used at an immersion depth (distance from a meniscus to an upper end of the molten steel spout) of 270 mm or more and less than 300 mm, a strength of the AC magnetic field applied to the upper magnetic poles is set to 0.060 to 0.090 T, a strength of a DC magnetic field applied to the upper magnetic poles is set to more than 0.18 T and 0.25 T or less, a strength of a DC magnetic field applied to the lower magnetic poles is set to 0.30 to 0.45 T, and continuous casting is conducted at casting speeds (a) to (f) below in accordance with slab width:

(a) When a slab width is 1050 mm or more and less than 1150 mm, the casting speed is 1.45 m/min or more and less than 2.65 m/min.

(b) When a slab width is 1150 mm or more and less than 1250 mm, the casting speed is 1.45 m/min or more and less than 2.25 m/min.

(c) When a slab width is 1250 mm or more and less than 1350 mm, the casting speed is 1.25 m/min or more and less than 2.25 m/min.

(d) When a slab width is 1350 mm or more and less than 1450 mm, the casting speed is 1.25 m/min or more and less than 2.05 m/min.

(e) When a slab width is 1450 mm or more and less than 1650 mm, the casting speed is 1.05 m/min or more and less than 1.85 m/min.

(f) When a slab width is 1650 mm or more and less than 1750 mm, the casting speed is 1.05 m/min or more and less than 1.65 m/min.

[9] A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, characterized in that the immersion nozzle is used at an immersion depth (distance from a meniscus to an upper end of the molten steel spout) of 270 mm or more and less than 300 mm, a strength of the AC magnetic field applied to the upper magnetic poles is set to 0.060 to 0.090 T, a strength of a DC magnetic field applied to the upper magnetic poles is set to more than 0.25 T and 0.35 T or less, a strength of a DC magnetic field applied to the lower magnetic poles is set to 0.30 to 0.45 T, and continuous casting is conducted at casting speeds (a) to (e) below in accordance with slab width:

(a) When a slab width is 1150 mm or more and less than 1350 mm, the casting speed is 2.25 m/min or more and less than 2.65 m/min.

(b) When a slab width is 1350 mm or more and less than 1450 mm, the casting speed is 2.05 m/min or more and less than 2.45 m/min.

(c) When a slab width is 1450 mm or more and less than 1550 mm, the casting speed is 1.85 m/min or more and less than 2.35 m/min.

(d) When a slab width is 1550 mm or more and less than 1650 mm, the casting speed is 1.85 m/min or more and less than 2.25 m/min.

(e) When a slab width is 1650 mm or more and less than 1750 mm, the casting speed is 1.65 m/min or more and less than 2.15 m/min.

[10] The continuous casting method according to any one of [1] to [9] above, characterized in that the molten steel in the mold has a turbulence energy on top surface: 0.0020 to 0.0035 $m^2/s^2$, a flow velocity on top surface: 0.30 m/s or less, and a flow velocity at a molten steel-solidification shell interface: 0.08 to 0.20 m/s.

[11] The continuous casting method according to [10] above, characterized in that the turbulence energy on top surface of the molten steel in the mold is 0.0020 to 0.0030 $m^2/s^2$.

[12] The continuous casting method according to [10] or [11] above, characterized in that the flow velocity on top surface of the molten steel in the mold is 0.05 to 0.30 m/s.

[13] The continuous casting method according to any one of [10] to [12] above, characterized in that the flow velocity of the molten steel in the mold is 0.14 to 0.20 m/s at the molten steel-solidification shell interface.

[14] The continuous casting method according to any one of [10] to [13] above, characterized in that a ratio A/B of a flow velocity A at the molten steel-solidification shell interface to a flow velocity B on top surface of the molten steel in the mold is 1.0 to 2.0.

[15] The continuous casting method according to any one of [10] to [14] above, characterized in that a bubble concentration of the molten steel in the mold is 0.01 $kg/m^3$ or less at the molten steel-solidification shell interface.

[16] The continuous casting method according [15] above, characterized in that a thickness of a slab to be cast is 220 to 300 mm and an amount of inert gas blown from an inner wall surface of the immersion nozzle is 3 to 25 NL/min.

[17] The continuous casting method according to any one of [1] to [16] above, characterized in that the strength of the AC magnetic field applied to the upper magnetic poles and the strengths of the DC magnetic fields respectively applied to the upper magnetic poles and the lower magnetic poles are automatically controlled with a computer for control by determining an AC current value to be fed to an AC magnetic field coil of the upper magnetic poles and each of DC current values to be fed to DC magnetic field coils of the upper magnetic poles and the lower magnetic poles by using at least one of a preliminarily set table and a mathematical formula on the basis of a width of a slab to be cast, the casting speed, and the immersion depth (distance from the meniscus to the upper end of the molten steel spout) of the immersion nozzle, and feeding an AC current and DC currents accordingly.

According to aspects of the present invention, in controlling the molten steel flow in a mold by using electromagnetic force, the strengths of the DC magnetic fields respectively applied to the upper magnetic poles and the lower magnetic poles and the strength of the AC magnetic field simultaneously applied to the upper magnetic poles are optimized in accordance with the width of the slab to be cast and the casting speed. As a result, a high-quality slab with very few defects related to fine bubbles and flux which have not been problematic can be obtained. Accordingly, a galvannealed steel sheet having a high-quality coating layer not known in the related art can be produced. Since the strength of the AC magnetic field simultaneously applied to the upper magnetic poles is set to a predetermined high level and the strengths of the DC magnetic fields respectively applied to the upper magnetic poles and the lower magnetic poles are controlled, the operation system for the AC magnetic field is no longer necessary. Thus, the control system for the magnetic field generator can be simplified and the facility cost can be significantly reduced.

DETAILED DESCRIPTION OF EMBODIMENTS

Figure 1:
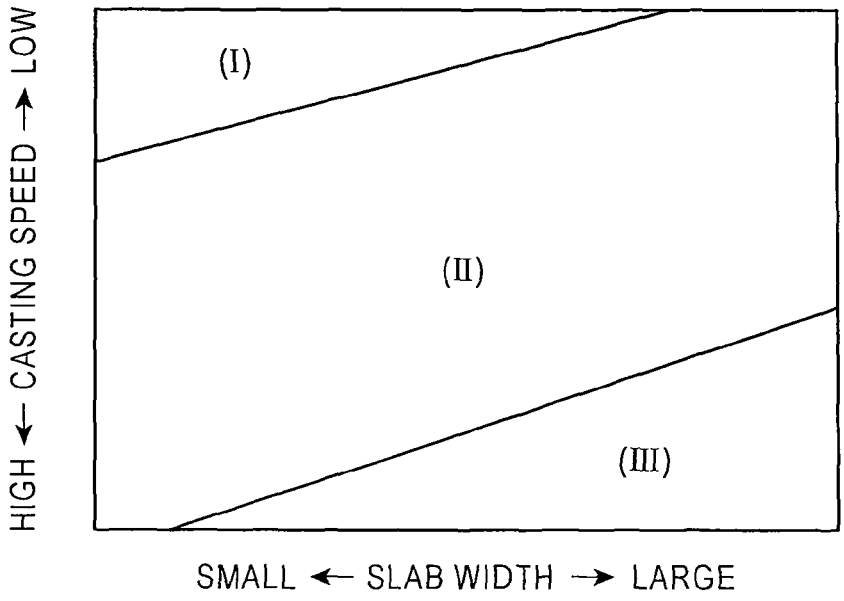
FIG. 1 is a schematic graph showing "slab width-casting speed" regions (I) to (III) where DC magnetic fields of different strengths are applied, according to aspects of the present invention.

According to a continuous casting method of the present invention, a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles is used. Using this continuous caster, continuous casting of steel is conducted, when a molten steel flow is braked with the DC magnetic fields respectively applied to the pair of upper magnetic poles and the pair of lower magnetic poles while stirring a molten steel with an AC magnetic field simultaneously applied to the pair of upper magnetic poles.

The inventor has studied the above-described continuous casting method through numerical simulation and the like. As a result, it has been found that a turbulence energy on top surface (involved in generation of a vortex near the surface), a flow velocity of molten steel at the molten steel-solidification shell interface (hereinafter simply referred to as "flow velocity at solidification interface"), and a flow velocity on top surface are the factors (primary factors) involved in generation of bubble defects and flux defects, and that these factors affect generation of defects. In particular it has also been found that the flow velocity on top surface and the turbulence energy on top surface affect entrainment of mold flux and the flow velocity at solidification interface affects the bubble defects. Based on these findings, actions of the DC magnetic fields and the AC magnetic field to be applied and the interaction observed when the two magnetic fields are simultaneously applied have been studied. The following points became clear.

(1) When an AC magnetic field is caused to act near a meniscus, the flow velocity at solidification interface is increased, the cleaning effect is enhanced, and the number of bubble defects is reduced on one hand. However, on the other hand, the flow velocity on top surface and the turbulence energy on top surface are increased, and this enhances the entrainment of mold flux and increases the number of flux defects.

(2) When a DC magnetic field is applied to the upper magnetic poles, an upward flow of molten steel (upward flow generated by reversal of a jet flow from the motel steel spout, the reversal being caused by collision with a mold short side) is braked, and the flow velocity on top surface and the turbulence energy on top surface can be reduced. However, the flow velocity on top surface, the turbulence energy on top surface, and the flow velocity at solidification interface cannot be controlled to an ideal state merely by such a DC magnetic field.

(3) In view of the above, simultaneous application of the AC magnetic field and the DC magnetic field at the upper magnetic poles can be considered to be effective in preventing both the bubble defects and the flux defects. However, a sufficient effect is not obtained merely by simultaneously applying the two magnetic fields. The casting conditions (the width of the slab to be cast and the casting speed), the application conditions for the AC magnetic field, and the application conditions for the DC magnetic fields respectively applied to the upper magnetic poles and the lower magnetic poles are interrelated and optimum ranges exist for these.

Aspects of the present invention are based on such findings and have made it possible to effectively suppress generation of bubble defects and flux defects by optimizing the strengths of the DC magnetic fields respectively applied to the upper magnetic poles and the lower magnetic poles and the strength of the AC magnetic field simultaneously applied to the upper magnetic poles in accordance with the width of the slab to be cast and the casting speed.

According to aspect of the present invention, it has been found that the strength of the AC magnetic field simultaneously applied to the upper magnetic poles is set to a predetermined high level and the strengths of the DC magnetic fields respectively applied to the upper magnetic poles and the lower magnetic poles should basically be optimized as in (I) to (III) below in accordance with the width of the slab to be cast and the casting speed. FIG. 1 is a schematic graph showing "slab width-casting speed" (horizontal axis-vertical axis) regions (I) to (III).

(I) "Slab width-casting speed" region in which the width of the slab to be cast and the casting speed are relatively small and the upper limit for the casting speed decreases with an increase in width of the slab to be cast: The jet flow velocity from the molten steel spout of an immersion nozzle is small and the swirling flow generated by the AC magnetic field is not readily interfered with an upward flow (reverse flow). Accordingly, the strength of the AC magnetic field simultaneously applied to the upper magnetic poles is set to a predetermined high level and the strength of the DC magnetic field (upper magnetic poles) for braking the upward flow is decreased. As a result, the turbulence energy on top surface, the flow velocity at solidification interface, and the flow velocity on top surface are controlled within adequate ranges and generation of the bubble defects and flux defects is prevented.

(II) "Slab width-casting speed" region in which the width of the slab to be cast and the casting speed are in a small-large range but the upper limit and the lower limit for the casting speed decrease with an increase in width of the slab to be cast: The jet flow velocity from the molten steel spout of an immersion nozzle is relatively large and thus the upward flow (reverse flow) is also increased and the swirling flow generated by the AC magnetic field is readily interfered with the upward flow. Accordingly, the strength of the AC magnetic field simultaneously applied to the upper magnetic poles is set to a predetermined high level and the strength of the DC magnetic field (upper magnetic poles) for braking the upward flow is set to a relatively high level. As a result, the turbulence energy on top surface, the flow velocity at solidification interface, and the flow velocity on top surface are controlled within adequate ranges and generation of the bubble defects and flux defects is prevented.

(III) "Slab width-casting speed" region in which the width of the slab to be cast and the casting speed are relatively large and the lower limit for the casting speed increases with a decrease in width of the slab to be cast: The jet flow velocity from the molten steel spout of an immersion nozzle is particularly large and thus the upward flow (reverse flow) is also increased greatly and the swirling flow generated by the AC magnetic field is readily interfered with the upward flow. Accordingly, the strength of the AC magnetic field simultaneously applied to the upper magnetic poles is set to a predetermined high level and the strength of the DC magnetic field (upper magnetic poles) for braking the upward flow is set to a particularly high level. In such a case, the flow velocity at solidification interface is adjusted to be in an adequate range by using a nozzle jet flow, and the turbulence energy on top surface and the flow velocity on top surface are controlled within adequate ranges by braking the upward flow with the DC magnetic field to prevent generation of the bubble defects and flux defects.

Figure 2:
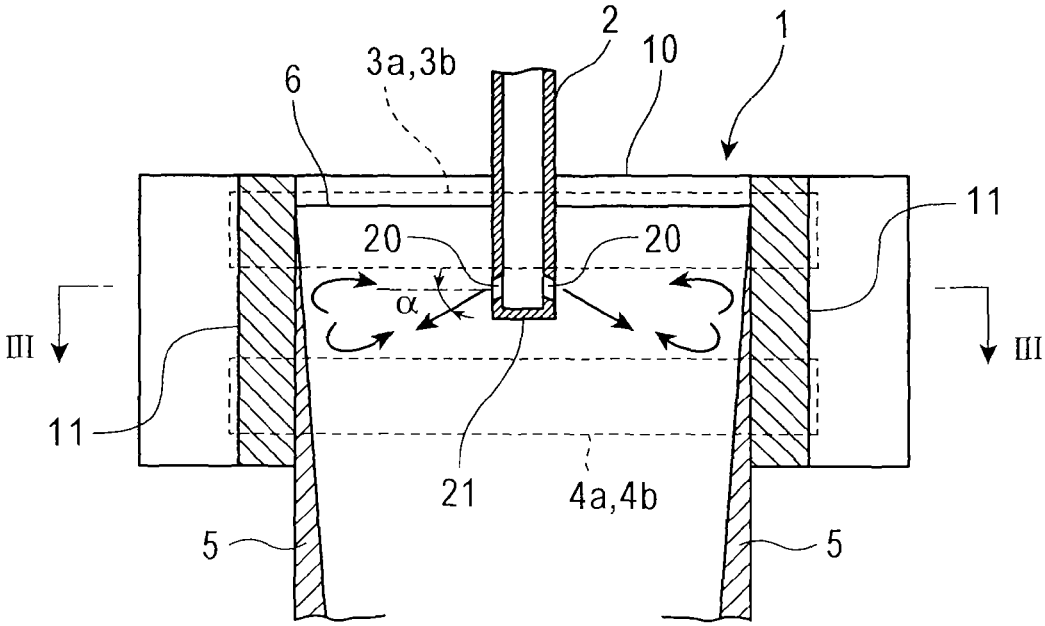
FIG. 2 is a vertical cross-sectional view showing one embodiment of a mold and an immersion nozzle of a continuous caster used in implementing aspects of the present invention.
Figure 3:
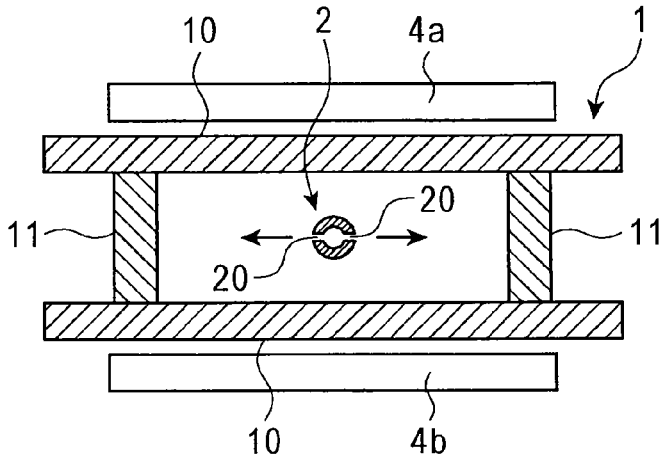
FIG. 3 is a horizontal cross-sectional view of the mold and the immersion nozzle of the embodiment shown in FIG. 2.

FIGS. 2 and 3 show one embodiment of a mold and an immersion nozzle of a continuous caster used in implementing aspects of the present invention. FIG. 2 is a vertical cross-sectional view of the mold and the immersion nozzle and FIG. 3 is a horizontal cross-sectional view (cross-sectional view taken along line III-III in FIG. 2) of the mold and the immersion nozzle. In the drawings, reference numeral 1 denotes a mold. The mold 1 has a rectangular horizontal cross-section constituted by mold long side portions 10 (mold side wall) and mold short side portions 11 (mold side wall). Reference numeral 2 denotes an immersion nozzle. Molten steel in a tundish (not shown) provided above the mold 1 is poured into the mold 1 through this immersion nozzle 2. The immersion nozzle 2 has a bottom 21 at the lower end of a cylindrical nozzle main body and a pair of molten steel spouts 20 are formed to penetrate the side wall portion directly above the bottom 21 so as to face the two mold short side portions 11.

In order to prevent nozzle clogging caused by adhesion and deposition of the non-metallic inclusions such as alumina in the molten steel onto an inner wall surface of the immersion nozzle 2, inert gas such as Ar gas is introduced into a gas channel (not shown) provided inside the nozzle main body of the immersion nozzle 2 or inside an upper nozzle (not shown) and the inert gas is blown into the nozzle from the nozzle inner wall surface. The molten steel that has flown into the immersion nozzle 2 from the tundish is discharged into the mold 1 from the pair of molten steel spouts 20 of the immersion nozzle 2. The discharged molten steel is cooled in the mold 1 to form a solidification shell 5 and continuously withdrawn downward from the mold 1 to form a slab. A mold flux is added to a meniscus 6 in the mold 1 and used as a thermal insulation material for the molten steel and a lubricant between the solidification shell 5 and the mold 1. Bubbles of the inert gas blown from the inner wall surface of the immersion nozzle 2 or inside the upper nozzle are discharged into the mold 1 from the molten steel spouts 20 along with the molten steel.

A pair of upper magnetic poles 3*a* and 3*b* and a pair of lower magnetic poles 4*a* and 4*b* that face each other with the mold long side portions therebetween are provided on the outer sides of the mold 1 (back surfaces of the mold side wall). The upper magnetic poles 3*a* and 3*b* and the lower magnetic poles 4*a* and 4*b* extend in the width direction of the mold long side portions 10 along the entire width. The upper magnetic poles 3*a* and 3*b* and the lower magnetic poles 4*a* and 4*b* are arranged so that the molten steel spouts 20 are positioned, in a vertical direction of the mold 1, between the peak position of the DC magnetic field of the upper magnetic poles 3*a* and 3*b* (the peak position in the vertical direction: usually the center position of the upper magnetic poles 3*a* and 3*b* in the vertical direction) and the peak position of the DC magnetic field of the lower magnetic poles 4*a* and 4*b* (the peak position in the vertical direction: usually the center position of the lower magnetic poles 4*a* and 4*b* in the vertical direction). The pair of the upper magnetic poles 3*a* and 3*b* is usually located at positions that cover the meniscus 6.

Figure 4:
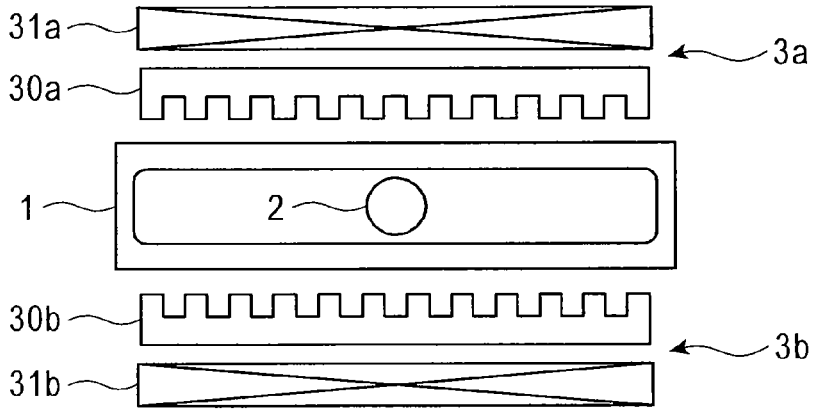
FIG. 4 is a schematic plan view showing one embodiment of upper magnetic poles equipped with a magnetic pole for a DC magnetic field and a magnetic pole for an AC magnetic field that are independent from each other used in the continuous caster used for implementing aspects of the present invention.

DC magnetic fields are respectively applied to the upper magnetic poles 3*a* and 3*b* and the lower magnetic poles 4*a* and 4*b* and an AC magnetic field is simultaneously applied to the upper magnetic poles 3*a* and 3*b*. Thus, the upper magnetic poles 3*a* and 3*b* are usually each equipped with a magnetic pole for a DC magnetic field and a magnetic pole for an AC magnetic field that are independent from each other (each of the magnetic poles is constituted by an iron core and a coil). As a result, each of the strengths of the DC magnetic field and the AC magnetic field simultaneously applied can be freely selected. FIG. 4 is a plan view schematically showing one embodiment of such upper magnetic poles 3*a* and 3*b*. A pair of magnetic poles 30*a* and 30*b* for an AC magnetic field (=AC magnetic field generator) is disposed on the outer sides of the two mold long side portions of the mold 1 and a pair of magnetic poles 31*a* and 31*b* for an DC magnetic field (=DC magnetic field generator) is disposed on the further outer sides thereof.

Each of the upper magnetic poles 3*a* and 3*b* may include a coil for a DC magnetic field and a coil for an AC magnetic field for a common iron core. When such a coil for DC magnetic field and a coil for an AC magnetic field that can be controlled independently are provided, each of the strengths of the DC magnetic field and the AC magnetic field simultaneously applied can be freely selected. In contrast, the lower magnetic poles 4*a* and 4*b* are each constituted by an iron core and a coil for a DC magnetic field.

The AC magnetic field applied simultaneously with the DC magnetic field may be an AC oscillating magnetic field or an AC shifting magnetic field. An AC oscillating magnetic field is a magnetic field generated by feeding AC currents having phases substantially reversed from each other to adjacent coils or by feeding AC currents having the same phase to the coils having winding directions opposite from each other so that the magnetic fields generated from the adjacent coils have substantially reversed phases. An AC shifting magnetic field is a magnetic field obtained by feeding AC currents having phases shifted by 360°/N to arbitrarily selected N adjacent coils. Usually, N=3 (phase difference: 120°) is employed to achieve high efficiency.

The molten steel discharged from the molten steel spouts 20 of the immersion nozzle 2 in the mold short side portion direction collides with the solidification shell 5 generated at the front of the mold short side portions 11 and divided into a downward flow and an upward flow. DC magnetic fields are respectively applied to the pair of the upper magnetic poles 3*a* and 3*b* and the pair of the lower magnetic poles 4*a* and 4*b* and the basic effects achieved by these magnetic poles are that the molten steel upward flow is braked (decelerated) with the DC magnetic field applied to the upper magnetic poles 3*a* and 3*b* and the molten steel downward flow is braked (decelerated) with the DC magnetic field applied to the lower magnetic poles 4*a* and 4*b* due to the electromagnetic force acting on the molten steel moving in the DC magnetic fields. The AC magnetic field simultaneously applied with the DC magnetic field to the pair of the upper magnetic poles 3*a* and 3*b* forcibly stirs the molten steel at the meniscus and the molten steel flow caused thereby achieves an effect of cleaning the non-metallic inclusions and bubbles at the solidification shell interface. Here, when the AC magnetic field is an AC shifting magnetic field, an effect of rotating and stirring the molten steel in a horizontal direction can be achieved.

According to aspects of the present invention, the casting conditions are selected in accordance with the immersion depth of the immersion nozzle 2 (the distance from the meniscus to the upper end of the molten steel spouts). The nozzle immersion depth of the immersion nozzle 2 is 180 mm or more and less than 300 mm. Adequate control of the molten steel flow becomes difficult when the nozzle immersion depth is too large or too small since the state of flow of the molten steel in the mold changes significantly as the amount and speed of the flow of the molten steel discharged from the immersion nozzle 2 change. When the nozzle immersion depth is less than 180 mm, the molten steel top surface (meniscus) directly changes as the amount and speed of the flow of the molten steel discharged from the immersion nozzle 2 change, the turbulence in the surface becomes significant, and entrainment of mold flux occurs readily. In contrast, when the depth is 300 mm or more, the speed of the downward flow increases by the change in amount of the flow of the molten steel and thus submersion of non-metallic inclusions and bubbles tends to become significant.

The casting speed is preferably 0.95 m/min or more from the productivity standpoint but adequate control is difficult at a casting speed of 2.65 m/min or more even according to aspects of the present invention. Thus, the casting speed of 0.95 m/min or more and less than 2.65 m/min is the range encompassed by aspects of the present invention.

Figure 5:
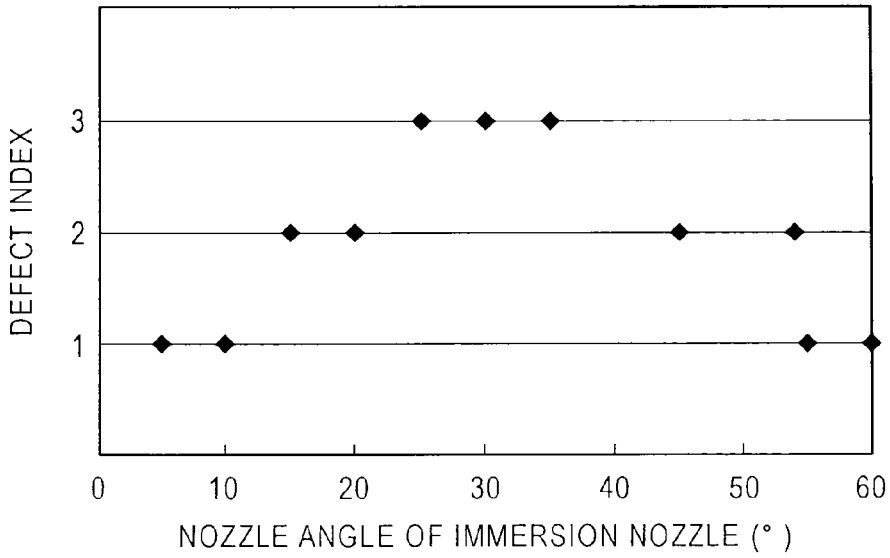
FIG. 5 is a graph showing the relationship between a molten steel discharge angle of the immersion nozzle and the incidence (defect index) of surface defects.

A molten steel discharge angle α (refer to FIG. 2) of the molten steel spouts 20 of the immersion nozzle 2, the angle being downward from the horizontal direction, is preferably 15° or more and less than 55°. At a molten steel discharge angle α of 55° or more, non-metallic inclusions and bubbles tend to move downward in the mold by the molten steel downward flow and tend to be trapped in the solidification shell despite braking of the molten steel downward flow using the DC magnetic field of the lower magnetic poles 4*a* and 4*b*. In contrast, at a molten steel discharge angle α less than 15°, the turbulence in the molten steel top surface cannot be controlled adequately and entrainment of mold flux easily occurs even when the molten steel upward flow is braked with the DC magnetic field. Further, in view of the above, a more preferable lower limit for the molten steel discharge angle α is 25° and a more preferable upper limit is 35°. FIG. 5 shows the relationship between the molten steel discharge angle α of the immersion nozzle and the incidence (defect index) of surface defects. In the studies shown in FIG. 5, a continuous casting test was conducted under various conditions that satisfy the ranges of aspects of the present invention regarding the magnetic field strengths, the nozzle immersion depth, the casting speed, and the slab width in the regions (I) to (III) described below; the resulting slab continuously cast was hot-rolled and cold-rolled to form a steel sheet; and the steel sheet was galvannealed to investigate the influence of the molten steel discharge angle α on occurrence of surface defects. Evaluation of the surface defects was conducted as follows. The galvannealed steel sheet described above was analyzed with an on-line surface defect meter to continuously measure surface defects and defects originating from steel making (flux defects and bubble defects) were identified from among the defects on the basis of the defect appearance, SEM analysis, ICP analysis, etc. The number of defect per 100 m of the coil length was evaluated by the following standard to determine the surface defect index:

3: The number of defects was 0.30 or less.

2: The number of defects was more than 0.30 and 1.00 or less.

1: The number of defects was more than 1.00.

Note that the minimum slab width cast by continuous casting is generally about 700 mm. A method of adding a solute element to a molten steel during casting in order to obtain a slab having a graded composition between the slab surface layer portion and the interior as disclosed in patent document 4 is not preferred since flux defects are likely to occur due to wires and the like for adding the solute element.

According to aspects of the present invention, the strength of the AC magnetic field simultaneously applied to the upper magnetic poles is set to a predetermined high level and the strengths of the DC magnetic fields respectively applied to the upper magnetic poles 3*a* and 3*b* and the lower magnetic poles 4*a* and 4*b* are optimized under the casting conditions (I) to (III) described above in accordance with the width of the slab to be cast and the casting speed so as to control the turbulence energy on top surface, the flow velocity at solidification interface, and the flow velocity on top surface in adequate ranges and to suppress entrainment of mold flux into the solidification shell 5 and entrapment of fine bubbles (mainly bubbles of inert gas blown from inside the upper nozzle) into the solidification shell that cause the flux defects and bubble defects.

The casting conditions in regions (I), (II), and (III) will now be described in that order.

Casting Conditions in Region (I)

In a "slab width-casting speed" region, such as region (I) in FIG. 1, where the width of the slab to be cast and the casting speed are relatively small and the upper limit for the casting speed decreases with an increase in width of the slab to be cast, the jet flow velocity from the molten steel spouts 20 of the immersion nozzle 2 is small and the swirling flow generated by the AC magnetic field applied to the upper magnetic poles 3*a* and 3*b* is not readily interfered with an upward flow (reverse flow). Accordingly, the strength of the AC magnetic field simultaneously applied to the upper magnetic poles 3*a* and 3*b* is set to a predetermined high level and the strength of the DC magnetic field (upper magnetic poles) applied to the upper magnetic poles 3*a* and 3*b* for braking the upward flow is decreased. In particular, the strength of the AC magnetic field applied to the upper magnetic poles 3*a* and 3*b* is set to 0.060 to 0.090 T, the strength of the DC magnetic field applied to the upper magnetic poles 3*a* and 3*b* is set to 0.02 to 0.18 T, and the strength of the DC magnetic field applied to the lower magnetic poles 4*a* and 4*b* is set to 0.30 to 0.45 T. As a result, the turbulence energy on top surface, the flow velocity at solidification interface, and the flow velocity on top surface can be controlled within adequate ranges.

When the strength of the AC magnetic field applied to the upper magnetic poles 3*a* and 3*b* is less than 0.060 T, the swirling flow generated by the AC magnetic field is readily interfered with the upward flow. Then the flow velocity at solidification interface cannot be increased stably, and bubble defects readily occur. In contrast, when the strength of the AC magnetic field exceeds 0.090 T, force of stirring the molten steel becomes excessively strong and thus the turbulence energy on top surface and the flow velocity on top surface are increased. Then the flux defects caused by entrainment of mold flux occur readily.

When the strength of the DC magnetic field applied to the upper magnetic poles 3*a* and 3*b* is less than 0.02 T, the effect of the DC magnetic field of braking the molten steel upward flow is insufficient. Accordingly, the bath surface is significantly fluctuated, and the turbulence energy on top surface and the flow velocity on top surface are increased. Then the flux defects caused by entrainment of mold flux occur readily. In contrast, when the strength of the DC magnetic field exceeds 0.18 T, the cleaning effect of the molten steel upward flow is decreased and thus non-metallic inclusions and bubbles are readily trapped in the solidification shell.

When the strength of the DC magnetic field applied to the lower magnetic poles 4*a* and 4*b* is less than 0.30 T, the effect of the DC magnetic field of braking the molten steel downward flow is insufficient, and thus non-metallic inclusions and bubbles accompanying the molten steel downward flow are submerged in the downward direction and readily trapped in the solidification shell. In contrast, when the strength of the DC magnetic field exceeds 0.45 T, the cleaning effect of the molten steel downward flow is decreased and thus non-metallic inclusions and bubbles are readily trapped in the solidification shell.

However, the flow state of the molten steel in the mold greatly changes according to the immersion depth of the immersion nozzle 2. In other words, the smaller the nozzle immersion depth is, it is the more likely that the molten steel top surface (meniscus) will be influenced by the flow state of the molten steel discharged from the immersion nozzle 2. In contrast, the larger the nozzle immersion depth is, it is the larger the downward flow velocity is. Since the flow state of the molten steel changes significantly as such according to the immersion depth of the immersion nozzle 2, the ranges of the width of the slab to be cast and the casting speed, i.e., the range of the region (I) schematically shown in FIG. 1 also changes in accordance with the immersion depth. In particular, the strength of the AC magnetic field applied to the upper magnetic poles 3*a* and 3*b* is set to 0.060 to 0.090 T, the strength of the DC magnetic field applied to the upper magnetic poles 3*a* and 3*b* is set to 0.02 to 0.18 T, and the strength of the DC magnetic field applied to the lower magnetic poles 4*a* and 4*b* is set to 0.30 to 0.45 T in the ranges (range of the region (I)) of the slab width and the casting speed in accordance with the immersion depth of the immersion nozzle 2 as in (I-1) to (I-3) below.

(I-1) The case when continuous casting is conducted at casting speeds (a) to (d) below in accordance with the slab width while the immersion depth of the immersion nozzle 2 is 180 mm or more and less than 240 mm.

(a) When the slab width is 950 mm or more and less than 1050 mm, the casting speed is 0.95 m/min or more and less than 1.65 m/min.

(b) When the slab width is 1050 mm or more and less than 1250 mm, the casting speed is 0.95 m/min or more and less than 1.45 m/min.

(c) When the slab width is 1250 mm or more and less than 1450 mm, the casting speed is 0.95 m/min or more and less than 1.25 m/min.

(d) When the slab width is 1450 mm or more and less than 1750 mm, the casting speed is 0.95 m/min or more and less than 1.05 m/min.

(I-2) The case when continuous casting is conducted at casting speeds (a) to (d) below in accordance with the slab width while the immersion depth of the immersion nozzle 2 is 240 mm or more and less than 270 mm.

(a) When the slab width is 950 mm or more and less than 1050 mm, the casting speed is 0.95 m/min or more and less than 1.65 m/min.

(b) When the slab width is 1050 mm or more and less than 1250 mm, the casting speed is 0.95 m/min or more and less than 1.45 m/min.

(c) When the slab width is 1250 mm or more and less than 1450 mm, the casting speed is 0.95 m/min or more and less than 1.25 m/min.

(d) When the slab width is 1450 mm or more and less than 1750 mm, the casting speed is 0.95 m/min or more and less than 1.05 m/min.

(I-3) The case when continuous casting is conducted at casting speeds (a) to (d) below in accordance with the slab width while the immersion depth of the immersion nozzle 2 is 270 mm or more and less than 300 mm.

(a) When the slab width is 950 mm or more and less than 1050 mm, the casting speed is 0.95 m/min or more and less than 1.65 m/min.

(b) When the slab width is 1050 mm or more and less than 1250 mm, the casting speed is 0.95 m/min or more and less than 1.45 m/min.

(c) When the slab width is 1250 mm or more and less than 1450 mm, the casting speed is 0.95 m/min or more and less than 1.25 m/min.

(d) When the slab width is 1450 mm or more and less than 1750 mm, the casting speed is 0.95 m/min or more and less than 1.05 m/min.

Casting Conditions in Region (II)

In a "Slab width-casting speed" region, such as a region (II) shown in FIG. 1, where the width of the slab to be cast and the casting speed are in a low-high, small-large range but the upper limit and the lower limit for the casting speed decrease with an increase in width of the slab to be cast, the jet flow velocity from the molten steel spouts 20 of the immersion nozzle 2 is relatively large and thus the upward flow (reverse flow) is also increased and the swirling flow generated by the AC magnetic field applied to the upper magnetic poles 3*a* and 3*b* is readily interfered with the upward flow. Accordingly, the strength of the AC magnetic field simultaneously applied to the upper magnetic poles 3*a* and 3*b* is set to a predetermined high level and the strength of the DC magnetic field applied to the upper magnetic poles 3*a* and 3*b* for braking the upward flow is set to a relatively high level. In particular, the strength of the AC magnetic field applied to the upper magnetic poles 3*a* and 3*b* is set to 0.060 to 0.090 T, the strength of the DC magnetic field applied to the upper magnetic poles 3*a* and 3*b* is set to more than 0.18 T and 0.25 T or less, and the strength of the DC magnetic field applied to the lower magnetic poles 4*a* and 4*b* is set to 0.30 to 0.45 T. As a result, the turbulence energy on top surface, the flow velocity at solidification interface, and the flow velocity on top surface can be controlled within adequate ranges.

As previously mentioned, when the strength of the AC magnetic field applied to the upper magnetic poles 3*a* and 3*b* is less than 0.060 T, the swirling flow generated by the AC magnetic field is readily interfered with the upward flow. Then the flow velocity at solidification interface cannot be increased stably, and bubble defects readily occur. In contrast, when the strength of the AC magnetic field exceeds 0.090 T, force of stirring the molten steel becomes excessively strong and thus the turbulence energy on top surface and the flow velocity on top surface are increased. Then the flux defects caused by entrainment of mold flux occur readily.

When the strength of the DC magnetic field applied to the upper magnetic poles 3*a* and 3*b* is 0.18 T or less, the effect of the DC magnetic field of braking the molten steel upward flow force is insufficient. Accordingly, the bath surface is significantly fluctuated, and the turbulence energy on top surface and the flow velocity on top surface are increased. Then the flux defects caused by entrainment of the mold flux occur readily. In contrast, when the strength of the DC magnetic field exceeds 0.25 T, the cleaning effect of the molten steel upward flow is decreased and thus non-metallic inclusions and bubbles are readily trapped in the solidification shell.

When the strength of the DC magnetic field applied to the lower magnetic poles 4*a* and 4*b* is less than 0.30 T, the effect of the DC magnetic field of braking the molten steel downward flow is insufficient, and thus non-metallic inclusions and bubbles accompanying the molten steel downward flow are submerged in the downward direction and readily trapped in the solidification shell. In contrast, when the strength of the DC magnetic field exceeds 0.45 T, the cleaning effect of the molten steel downward flow is decreased and thus non-metallic inclusions and bubbles are readily trapped in the solidification shell.

However, the flow state of the molten steel in the mold greatly changes according to the immersion depth of the immersion nozzle 2. In other words, the smaller the nozzle immersion depth is, it is the more likely that the molten steel top surface (meniscus) will be influenced by the flow state of the molten steel discharged from the immersion nozzle 2. In contrast, the larger the nozzle immersion depth is, it is more likely that the larger the downward flow velocity is. Since the flow state of the molten steel changes significantly as such according to the immersion depth of the immersion nozzle 2, the ranges of the width of the slab to be cast and the casting speed, i.e., the range of the region (II) schematically shown in FIG. 1 also changes in accordance with the immersion depth. In particular, the strength of the AC magnetic field applied to the upper magnetic poles 3*a* and 3*b* is set to 0.060 to 0.090 T, the strength of the DC magnetic field applied to the upper magnetic poles 3*a* and 3*b* is set to more than 0.18 T and 0.25 T or less, and the strength of the DC magnetic field applied to the lower magnetic poles 4*a* and 4*b* is set to 0.30 to 0.45 T in the ranges (range of the region (II)) of the slab width and the casting speed in accordance with the immersion depth of the immersion nozzle 2 as in (II-1) to (II-3) below.

(II-1) The case when continuous casting is conducted at casting speeds (a) to (e) below in accordance with the slab width while the immersion depth of the immersion nozzle 2 is 180 mm or more and less than 240 mm.

(a) When the slab width is 1050 mm or more and less than 1150 mm, the casting speed is 1.45 m/min or more and less than 2.25 m/min.

(b) When the slab width is 1150 mm or more and less than 1250 mm, the casting speed is 1.45 m/min or more and less than 2.05 m/min.

(c) When the slab width is 1250 mm or more and less than 1350 mm, the casting speed is 1.25 m/min or more and less than 2.05 m/min.

(d) When the slab width is 1350 mm or more and less than 1450 mm, the casting speed is 1.25 m/min or more and less than 1.85 m/min.

(e) When the slab width is 1450 mm or more and less than 1750 mm, the casting speed is 1.05 m/min or more and less than 1.65 m/min.

(II-2) The case when continuous casting is conducted at casting speeds (a) to (f) below in accordance with the slab width while the immersion depth of the immersion nozzle 2 is 240 mm or more and less than 270 mm.

(a) When the slab width is 1050 mm or more and less than 1150 mm, the casting speed is 1.45 m/min or more and less than 2.45 m/min.

(b) When the slab width is 1150 mm or more and less than 1250 mm, the casting speed is 1.45 m/min or more and less than 2.25 m/min.

(c) When the slab width is 1250 mm or more and less than 1350 mm, the casting speed is 1.25 m/min or more and less than 2.05 m/min.

(d) When the slab width is 1350 mm or more and less than 1450 mm, the casting speed is 1.25 m/min or more and less than 1.85 m/min.

(e) When the slab width is 1450 mm or more and less than 1550 mm, the casting speed is 1.05 m/min or more and less than 1.85 m/min.

(f) When the slab width is 1550 mm or more and less than 1750 mm, the casting speed is 1.05 m/min or more and less than 1.65 m/min.

(II-3) The case when continuous casting is conducted at casting speeds (a) to (f) below in accordance with the slab width while the immersion depth of the immersion nozzle 2 is 270 mm or more and less than 300 mm.

(a) When the slab width is 1050 mm or more and less than 1150 mm, the casting speed is 1.45 m/min or more and less than 2.65 m/min.

(b) When the slab width is 1150 mm or more and less than 1250 mm, the casting speed is 1.45 m/min or more and less than 2.25 m/min.

(c) When the slab width is 1250 mm or more and less than 1350 mm, the casting speed is 1.25 m/min or more and less than 2.25 m/min.

(d) When the slab width is 1350 mm or more and less than 1450 mm, the casting speed is 1.25 m/min or more and less than 2.05 m/min.

(e) When the slab width is 1450 mm or more and less than 1650 mm, the casting speed is 1.05 m/min or more and less than 1.85 m/min.

(f) When the slab width is 1650 mm or more and less than 1750 mm, the casting speed is 1.05 m/min or more and less than 1.65 m/min.

Casting Conditions in Region (III)

In a "slab width-casting speed" region, such as a region (III) in FIG. 1, where the width of the slab to be cast and the casting speed are relatively large and the lower limit for the casting speed increases with a decrease in width of the slab to be cast, the jet flow velocity from the molten steel spouts 20 of the immersion nozzle 2 is particularly large and thus the upward flow (reversed flow) is also significantly large, thereby the large flow velocity of molten steel at interface is induced. Accordingly, in order to suppress interference with the swirling flow, the swirling magnetic field strength is adjusted. In other words, the strength of the AC magnetic field simultaneously applied to the upper magnetic poles 3*a* and 3*b* is set to a predetermined high level and the strength of the DC magnetic field (upper magnetic poles) applied to the upper magnetic poles 3*a* and 3*b* for braking the upward flow is particularly increased. In particular, the strength of the AC magnetic field applied to the upper magnetic poles 3*a* and 3*b* is set to 0.060 to 0.090 T, the strength of the DC magnetic field applied to the upper magnetic poles 3*a* and 3*b* is set to more than 0.25 T and 0.35 T or less, and the strength of the DC magnetic field applied to the lower magnetic poles 4*a* and 4*b* is set to 0.30 to 0.45 T. As a result, the turbulence energy on top surface, the flow velocity at solidification interface, and the flow velocity on top surface can be controlled within adequate ranges.

As previously mentioned, when the strength of the AC magnetic field applied to the upper magnetic poles 3*a* and 3*b* is less than 0.060 T, the swirling flow generated by the AC magnetic field is readily interfered with the upward flow. Then the flow velocity at solidification interface cannot be increased stably, and bubble defects readily occur. In contrast, when the strength of the AC magnetic field exceeds 0.090 T, force of stirring the molten steel becomes excessively strong and thus the turbulence energy on top surface and the flow velocity on top surface are increased. Then the flux defects caused by entrainment of mold flux occur readily.

When the strength of the DC magnetic field applied to the upper magnetic poles 3*a* and 3*b* is 0.25 T or less, the effect of the DC magnetic field of braking the molten steel upward flow force is insufficient. Accordingly, the bath surface is significantly fluctuated, and the turbulence energy on top surface and the flow velocity on top surface are increased. Then the flux defects caused by entrainment of the mold flux occur readily. In contrast, when the strength of the DC magnetic field exceeds 0.35 T, the cleaning effect of the molten steel upward flow is decreased and thus non-metallic inclusions and bubbles are readily trapped in the solidification shell.

When the strength of the DC magnetic field applied to the lower magnetic poles 4*a* and 4*b* is less than 0.30 T, the effect of the DC magnetic field of braking the molten steel downward flow is insufficient, and thus non-metallic inclusions and bubbles accompanying the molten steel downward flow are submerged in the downward direction and readily trapped in the solidification shell. In contrast, when the strength of the DC magnetic field exceeds 0.45 T, the cleaning effect of the molten steel downward flow is decreased and thus non-metallic inclusions and bubbles are readily trapped in the solidification shell.

However, the flow state of the molten steel in the mold greatly changes according to the immersion depth of the immersion nozzle 2. In other words, the smaller the nozzle immersion depth is, it is the more likely that the molten steel top surface (meniscus) will be influenced by the flow state of the molten steel discharged from the immersion nozzle 2. In contrast, the larger the nozzle immersion depth is, the larger the downward flow velocity is. Since the flow state of the molten steel changes significantly as such according to the immersion depth of the immersion nozzle 2, the ranges of the width of the slab to be cast and the casting speed, i.e., the range of the region (III) schematically shown in FIG. 1, also changes in accordance with the immersion depth. In particular, the strength of the AC magnetic field applied to the upper magnetic poles 3*a* and 3*b* is set to 0.060 to 0.090 T, the strength of the DC magnetic field applied to the upper magnetic poles 3*a* and 3*b* is set to more than 0.25 T and 0.35 T or less, and the strength of the DC magnetic field applied to the lower magnetic poles 4*a* and 4*b* is set to 0.30 to 0.45 T in the ranges (range of the region (III)) of the slab width and the casting speed in accordance with the immersion depth of the immersion nozzle 2 as in (III-1) to (III-3) below.

(III-1) The case when continuous casting is conducted at casting speeds (a) to (f) below in accordance with the slab width while the immersion depth of the immersion nozzle 2 is 180 mm or more and less than 240 mm.

(a) When the slab width is 1050 mm or more and less than 1150 mm, the casting speed is 2.25 m/min or more and less than 2.65 m/min.

(b) When the slab width is 1150 mm or more and less than 1350 mm, the casting speed is 2.05 m/min or more and less than 2.65 m/min.

(c) When the slab width is 1350 mm or more and less than 1450 mm, the casting speed is 1.85 m/min or more and less than 2.45 m/min.

(d) When the slab width is 1450 mm or more and less than 1550 mm, the casting speed is 1.65 m/min or more and less than 2.35 m/min.

(e) When the slab width is 1550 mm or more and less than 1650 mm, the casting speed is 1.65 m/min or more and less than 2.25 m/min.

(f) When the slab width is 1650 mm or more and less than 1750 mm, the casting speed is 1.65 m/min or more and less than 2.15 m/min.

(III-2) The case when continuous casting is conducted at casting speeds (a) to (g) below in accordance with the slab width while the immersion depth of the immersion nozzle 2 is 240 mm or more and less than 270 mm.

(a) When the slab width is 1050 mm or more and less than 1150 mm, the casting speed is 2.45 m/min or more and less than 2.65 m/min.

(b) When the slab width is 1150 mm or more and less than 1250 mm, the casting speed is 2.25 m/min or more and less than 2.65 m/min.

(c) When the slab width is 1250 mm or more and less than 1350 mm, the casting speed is 2.05 m/min or more and less than 2.65 m/min.

(d) When the slab width is 1350 mm or more and less than 1450 mm, the casting speed is 1.85 m/min or more and less than 2.45 m/min.

(e) When the slab width is 1450 mm or more and less than 1550 mm, the casting speed is 1.85 m/min or more and less than 2.35 m/min.

(f) When the slab width is 1550 mm or more and less than 1650 mm, the casting speed is 1.65 m/min or more and less than 2.25 m/min.

(g) When the slab width is 1650 mm or more and less than 1750 mm, the casting speed is 1.65 m/min or more and less than 2.15 m/min.

(III-3) The case when continuous casting is conducted at casting speeds (a) to (e) below in accordance with the slab width while the immersion depth of the immersion nozzle 2 is 270 mm or more and less than 300 mm.

(a) When the slab width is 1150 mm or more and less than 1350 mm, the casting speed is 2.25 m/min or more and less than 2.65 m/min.

(b) When the slab width is 1350 mm or more and less than 1450 mm, the casting speed is 2.05 m/min or more and less than 2.45 m/min.

(c) When the slab width is 1450 mm or more and less than 1550 mm, the casting speed is 1.85 m/min or more and less than 2.35 m/min.

(d) When the slab width is 1550 mm or more and less than 1650 mm, the casting speed is 1.85 m/min or more and less than 2.25 m/min.

(e) When the slab width is 1650 mm or more and less than 1750 mm, the casting speed is 1.65 m/min or more and less than 2.15 m/min.

As described above, when the strength of the AC magnetic field simultaneously applied to the upper magnetic poles 3*a* and 3*b* is set to a predetermined high level and the strength of the DC magnetic fields respectively applied to the upper magnetic poles 3*a* and 3*b* and the lower magnetic poles 4*a* and 4*b* are optimized in accordance with the width of the slab to be cast and the casting speed, the turbulence energy on top surface, the flow velocity at solidification interface, and the flow velocity on top surface, which are the factors involved in generation of bubble defects and flux defects (factor involved in the molten steel flow in the mold) are adequately controlled. Thus, a state in which entrapment of bubbles in the solidification interface and entrainment of mold flux rarely occur can be realized and a high-quality slab having few defects related to bubbles and mold flux can be obtained. The continuous casting method of aspects of the present invention described above can also be regarded as three continuous casting methods (A) to (C) below.

(A) In a steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, a strength of the AC magnetic field applied to the upper magnetic poles is set to 0.060 to 0.090 T, a strength of a DC magnetic field applied to the upper magnetic poles is set to 0.02 to 0.18 T, a strength of a DC magnetic field applied to the lower magnetic poles is set to 0.30 to 0.45 T when continuous casting is conducted under any one of previously discussed conditions (I-1) to (I-3) (ranges of the slab widths and casting speed in accordance with the immersion depth of the immersion nozzle).

(B) In a steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, a strength of the AC magnetic field applied to the upper magnetic poles is set to 0.060 to 0.090 T, a strength of a DC magnetic field applied to the upper magnetic poles is set to more than 0.18 T and 0.25 T or less, a strength of a DC magnetic field applied to the lower magnetic poles is set to 0.30 to 0.45 T when continuous casting is conducted under any one of previously discussed conditions (II-1) to (II-3) (ranges of the slab widths and casting speed in accordance with the immersion depth of the immersion nozzle).

(C) In a steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, a strength of the AC magnetic field applied to the upper magnetic poles is set to 0.060 to 0.090 T, a strength of a DC magnetic field applied to the upper magnetic poles is set to more than 0.25 T and 0.35 T or less, a strength of a DC magnetic field applied to the lower magnetic poles is set to 0.30 to 0.45 T when continuous casting is conducted under any one of previously discussed conditions (III-1) to (III-3) (ranges of the slab widths and casting speed in accordance with and the immersion depth of the immersion nozzle).

In implementing aspects of the present invention, preferably, a computer for control is used, an AC current value to be fed to an AC magnetic field coil of an upper magnetic pole and DC current values to be fed to DC magnetic field coils of the upper magnetic pole and the lower magnetic pole are determined by using at least one of a preliminarily set table and a mathematical formula on the basis of the width of the slab to be cast, the casting speed, and the immersion depth of the immersion nozzle (the distance from the meniscus to the upper end of the molten steel spout), and the AC current and the DC currents are fed to automatically control the strength of the AC magnetic field applied to the upper magnetic poles and the strengths of the DC magnetic fields respectively applied to the upper magnetic poles and the lower magnetic poles. Further, the casting conditions based on which the current values are determined may include the slab thickness, the molten steel discharge angle of the molten steel spout of the immersion nozzle, the angle being the downward angle from the horizontal direction, and the amount of inert gas blown from the inner wall surface of the immersion nozzle.

Figure 6:
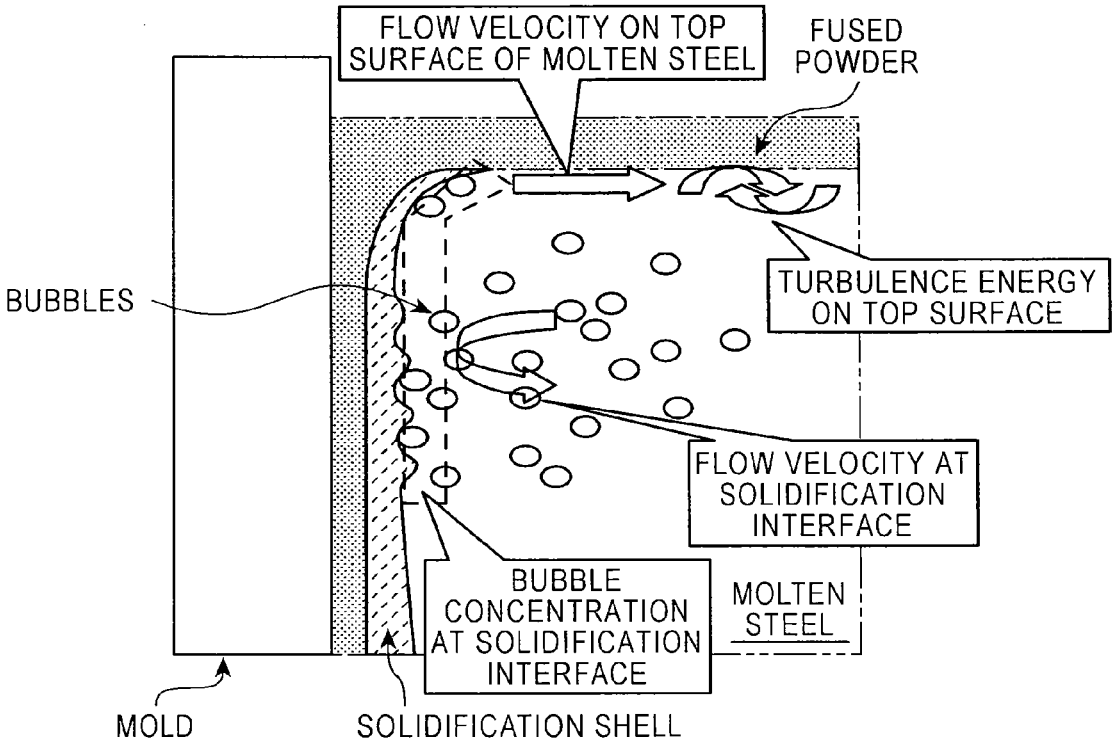
FIG. 6 is a conceptual diagram showing a turbulence energy on top surface, a flow velocity at solidification interface (flow velocity at the molten steel-solidification shell interface), a flow velocity on top surface, and a bubble concentration at solidification interface (bubble concentration at the molten steel-solidification shell interface) of molten steel in a mold.

FIG. 6 is a conceptual diagram showing the turbulence energy on top surface, the flow velocity at solidification interface (flow velocity at the molten steel-solidification shell interface), the flow velocity on top surface, and the bubble concentration at solidification interface (bubble concentration at the molten steel-solidification shell interface) of molten steel in a mold. The turbulence energy on top surface (indicated by the second balloon from the top in FIG. 6) of the molten steel is a spatial average value of a k value determined from the formula below and defined by a numerical flow simulation using a three dimensional k-ϵ model defined by fluid dynamics. Here, the molten steel discharge angle of the immersion nozzle, the nozzle immersion depth, and the inert gas (e.g., Ar) blowing rate considering volume expansion should be considered. For example, when the inert gas blowing rate is 15 NL/min, the volume expansion ratio is 6. In other words, the numerical analysis model is a model that considers a momentum, a continuity equation, and a k-ϵ model of turbulent flow coupled with a field Lorentz force and the lifting effect of nozzle blowing. (Based on the description of a two equation model on p. 129- of Non-patent document: "Handbook of Computational Fluid Dynamics" (published Mar. 31, 2003))

$$k = \frac{1}{2}\left(\overline{v_X'^2} + \overline{v_Y'^2} + \overline{v_Z'^2}\right) \quad \text{[Math. 1]}$$

Where $v'_X = \delta v_X/\delta t$ $v'_Y = \delta v_Y/\delta t$ $v'_X = \delta v_X/\delta t$ $v_X$: Flow velocity (m/s) in X direction at molten steel top surface (bath surface)

$v_Y$: Flow velocity (m/s) in Y direction at molten steel top surface (bath surface)

$v_Z$: Flow velocity (m/s) in Z direction at molten steel top surface (bath surface)

The flow velocity at solidification interface (molten steel flow velocity at the molten steel-solidification shell interface) (indicated by the second balloon from the bottom in FIG. 6) is a spatial average value of the molten steel flow velocity at a position 50 mm below the meniscus and having a solid fraction fs of 0.5. Dependency of molten steel viscosity on temperature in addition to latent heat of solidification and heat transfer should be considered in the flow velocity at solidification interface. The detailed calculation conducted by the present inventors has found that the flow velocity at solidification interface at a solid fraction fs=0.5 is equivalent to a half of the flow velocity that determined by dendrite tilt angle measurement (fs=0). In other words, if the calculated flow velocity at solidification interface is 0.1 m/s at fs=0.5, the flow velocity at solidification interface determined on the basis of the dendrite tilt angle (fs=0) of the slab is 0.2 m/s. Note that the flow velocity at solidification interface determined from the dendrite tilt angle (fs=0) of the slab is equal to the flow velocity at solidification interface at a position having a solid fraction fs=0 at the solidification front surface. Here, the dendrite tilt angle is a tilt angle of a primary branch of dendrite extending in a thickness direction from a surface with respect to a normal direction to a slab surface. (Non-patent document: Tetsu-to-Hagane [Iron and Steel], Year 61 (1975), No. 14 "Relation between Large Inclusions and Growth Directions of Columnar Dendrites in Continuously Cast Slabs", pp. 2982-2990)

The flow velocity on top surface (indicated by the top balloon in FIG. 6) is a spatial average value of the molten steel flow velocity at the molten steel top surface (bath surface). This is also defined by the aforementioned three-dimensional numerical analysis model. Here, the flow velocity on top surface is coincident with the drag measured by using an immersed rod. However, according to the present definition, the flow velocity on top surface is an area average position thereof and thus can be calculated by numerical computation. In particular, the numerical analysis of the turbulence energy on top surface, the flow velocity at solidification interface, and the flow velocity on top surface can be conducted as below. For example, the numerical analysis can be accomplished by a general-purpose fluid analysis software Fluent or the like using a model that considers a momentum, a continuity equation, and a turbulent flow model (k-$\epsilon$ model) coupled with magnetic field analysis and a gas bubble distribution. (Based on the description of a user's manual of Non-patent document: Fluent 6.3 (Fluent Inc. USA))

Figure 7:
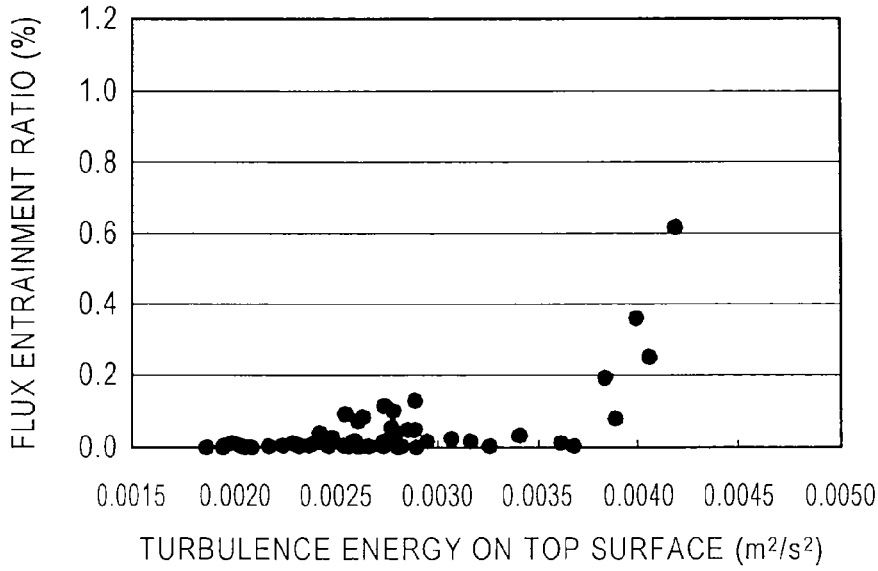
FIG. 7 is a graph showing the relationship between a turbulence energy on top surface of the molten steel in the mold and a flux entrainment ratio.

The turbulence energy on top surface significantly affects the entrainment of mold flux. As the turbulence energy on top surface increases, entrainment of mold flux is induced, thereby increasing the number of flux defects. In contrast, when the turbulence energy on top surface is too small, the mold flux does not sufficiently form slag. FIG. 7 shows the relationship between the turbulence energy on top surface (horizontal axis: unit $m^2/s^2$) and the flux entrainment ratio (percentage (%) of the flux entrapped from among flux evenly scattered onto the molten steel surface (top surface) (vertical axis)). Other conditions were as follows: flow velocity at solidification interface: 0.14 to 0.20 m/s, flow velocity on top surface: 0.05 to 0.30 m/s, bubble concentration at solidification interface: 0.01 $kg/m^3$ or less. According to FIG. 7, entrainment of mold flux is effectively suppressed and the mold flux satisfactorily forms slag at a turbulence energy on top surface in the range of 0.0020 to 0.0035 $m^2/s^2$. The entrainment of mold flux is particularly suppressed at 0.0030 $m^2/s^2$ or less. However, the mold flux does not sufficiently form slag at 0.0020 $m^2/s^2$ or less. Accordingly, the turbulence energy on top surface is 0.0020 to 0.0035 $m^2/s^2$ and preferably 0.0020 to 0.0030 $m^2/s^2$.

Figure 8:
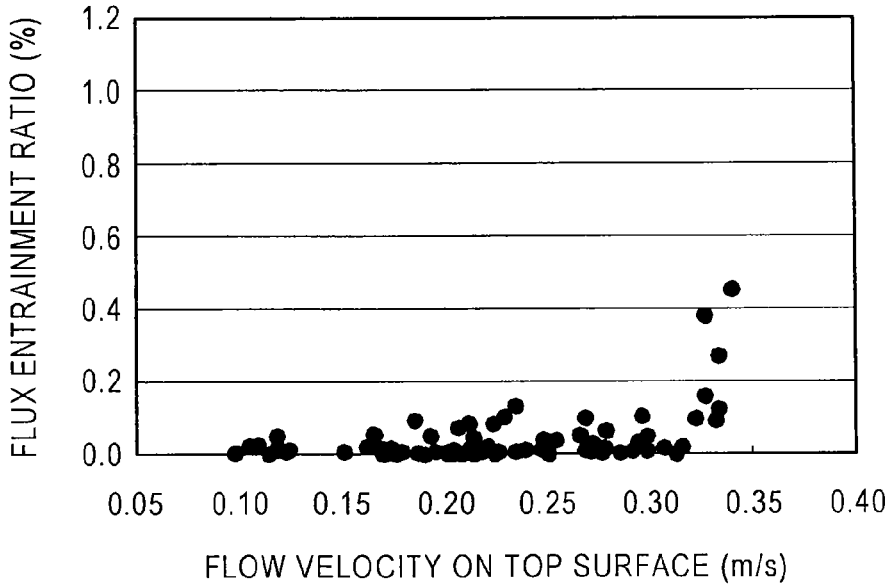
FIG. 8 is a graph showing the relationship between a flow velocity on top surface of the molten steel in the mold and a flux entrainment ratio.

The flow velocity on top surface also significantly affects the entrainment of mold flux. Entrainment of mold flux is induced more as the flow velocity on top surface is increased, thereby increasing the number of flux defects. FIG. 8 shows the relationship between the flow velocity on top surface (horizontal axis: unit m/s) and the flux entrainment ratio (percentage (%) of flux entrained from among flux evenly scattered onto the molten steel surface (top surface)(vertical axis)). Other conditions were as follows: turbulence energy on top surface: 0.0020 to 0.0030 $m^2/s^2$, flow velocity at solidification interface: 0.14 to 0.20 m/s, and bubble concentration at solidification interface: 0.01 $kg/m^3$ or less. According to FIG. 8, the entrainment of mold flux is effectively suppressed at 0.30 m/s or less. Accordingly, the flow velocity on top surface is preferably 0.30 m/s or less. When the flow velocity on top surface is too low, a region in which the temperature of the molten steel top surface is low is generated. Then slag inclusion caused by insufficient melting of mold flux and partial solidification of the molten steel are enhanced, thereby rendering the operation difficult. Accordingly, the flow velocity on top surface is preferably 0.05 m/s or more. The flow velocity on top surface here is a spatial average value at the molten steel top surface and defined by fluid computation. In measurement, an immersion rod is inserted from the top to measure the drag; however, this measurement is conducted only at a particular point and is thus used to verify the calculation described above.

Figure 9:
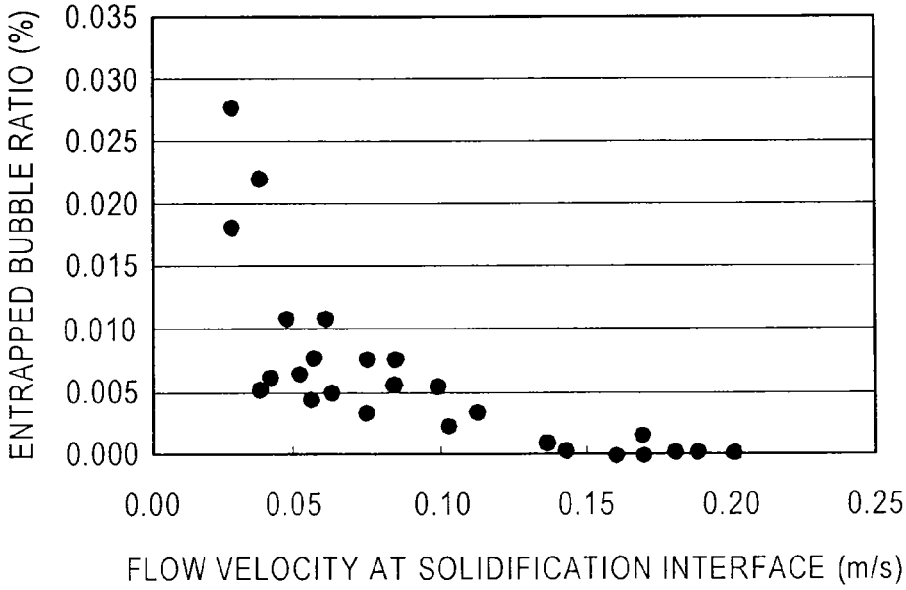
FIG. 9 is a graph showing the relationship between a flow velocity at solidification interface (flow velocity at molten steel-solidification shell interface) of the molten steel in the mold and an entrapped bubble ratio.

The flow velocity at solidification interface significantly affects entrapment of bubbles and inclusions in the solidification shell. When the flow velocity at solidification interface is low, bubbles and inclusions are readily trapped in the solidification shell, thereby increasing the number of bubble defects and the like. In contrast, when the flow velocity at solidification interface is excessively high, re-melting of the solidification shell once formed occurs and inhibits growth of the solidification shell. In the worst case, this leads to break-out and shutdown of operation, which poses a serious problem in productivity. FIG. 9 shows the relationship between the flow velocity at solidification interface (horizontal axis: unit m/s) and the entrapped bubble ratio (percentage (%) of bubbles entrapped from among bubbles scattered in the nozzle (vertical axis)). Other conditions were as follows: turbulence energy on top surface: 0.0020 to 0.0030 $m^2/s^2$, flow velocity on top surface: 0.05 to 0.30 m/s, and bubble concentration at solidification interface: 0.01 $kg/m^3$ or less. According to FIG. 9, entrapment of bubbles in the solidification shell is effectively suppressed in a flow velocity at solidification interface range of 0.08 m/s or more. Further, entrapment of bubbles is particularly little at 0.14 m/s or more. The problem regarding productivity, such as break-out caused by inhibition of growth of the solidification shell does not occur as long as the flow velocity at solidification interface is 0.20 m/s or less. Accordingly, the flow velocity at solidification interface is 0.08 to 0.20 m/s and preferably 0.14 to 0.20 m/s.

Figure 10:
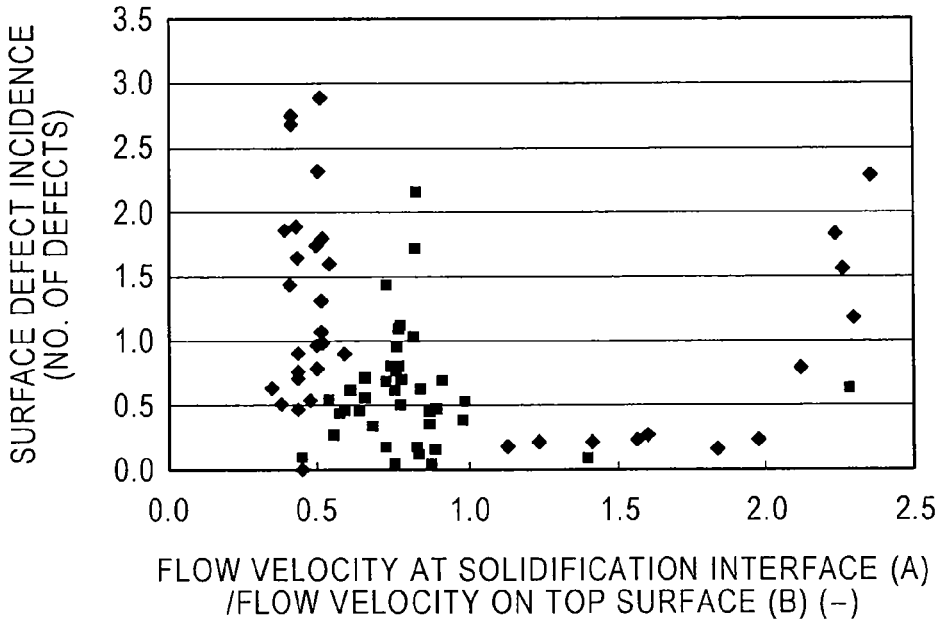
FIG. 10 is a graph showing the relationship between a ratio A/B of a flow velocity at solidification interface A to a flow velocity on top surface B of the molten steel in the mold and a surface defect incidence.

A ratio A/B of the flow velocity at solidification interface A to the flow velocity on top surface B affects both entrapment of the bubbles and entrainment of mold flux. The smaller the ratio A/B is, the more likely bubbles and inclusions will be trapped in the solidification shell, resulting in an increase in the number of bubble defects and the like. When the ratio A/B is excessively large, entrainment of mold powder is likely to occur and the number of flux defects is increased. FIG. 10 shows the relationship between the ratio A/B (horizontal axis) and the surface defect incidence (the number of defects per 100 m of a steel strip detected with a surface defect meter (vertical axis)). Other conditions were as follows: turbulence energy on top surface: 0.0020 to 0.0030 $m^2/s^2$, flow velocity on top surface: 0.05 to 0.30 m/s, flow velocity at solidification interface: 0.14 to 0.20 m/s, and bubble concentration at solidification interface: 0.01 $kg/m^3$. According to FIG. 10, the surface quality defect is particularly good at an A/B ratio of 1.0 to 2.0. Accordingly, the ratio A/B of the flow velocity at solidification interface A to the flow velocity on top surface B is preferably 1.0 to 2.0.

Based on the points discussed above, the flow state of the molten steel in a mold is preferably as follows: turbulence energy on top surface: 0.0020 to 0.0035 $m^2/s^2$, flow velocity on top surface: 0.30 m/s or less, and flow velocity at the molten steel-solidification shell interface: 0.08 to 0.20 m/s. The turbulence energy on top surface is more preferably 0.0020 to 0.0030 $m^2/s^2$, the flow velocity on top surface is more preferably 0.05 to 0.30 m/s and the flow velocity at solidification interface is more preferably 0.14 to 0.20 m/s. The ratio A/B of the flow velocity at solidification interface A to the flow velocity on top surface B is preferably 1.0 to 2.0.

Another factor involved in generation of bubble defects is the bubble concentration at the molten steel-solidification shell interface (hereinafter simply referred to as "bubble concentration at solidification interface") (indicated by the bottom balloon in FIG. 6). When the bubble concentration at solidification interface is adequately controlled, entrapment of bubbles at the solidification interface can be more adequately suppressed. The bubble concentration at solidification interface is defined by the aforementioned numerical calculation as a concentration of bubbles 1 mm in diameter at a position 50 mm below the meniscus and having a solid fraction fs of 0.5. Here, for the purpose of the calculation, the number N of bubbles blown into the nozzle is assumed to be N=AD−5, where A denotes blown gas velocity and D denotes a bubble diameter (Non-patent document: ISIJ Int. Vol. 43 (2003), No. 10, pp. 1548-1555). The blown gas velocity is generally 5 to 20 NL/min.

Figure 11:
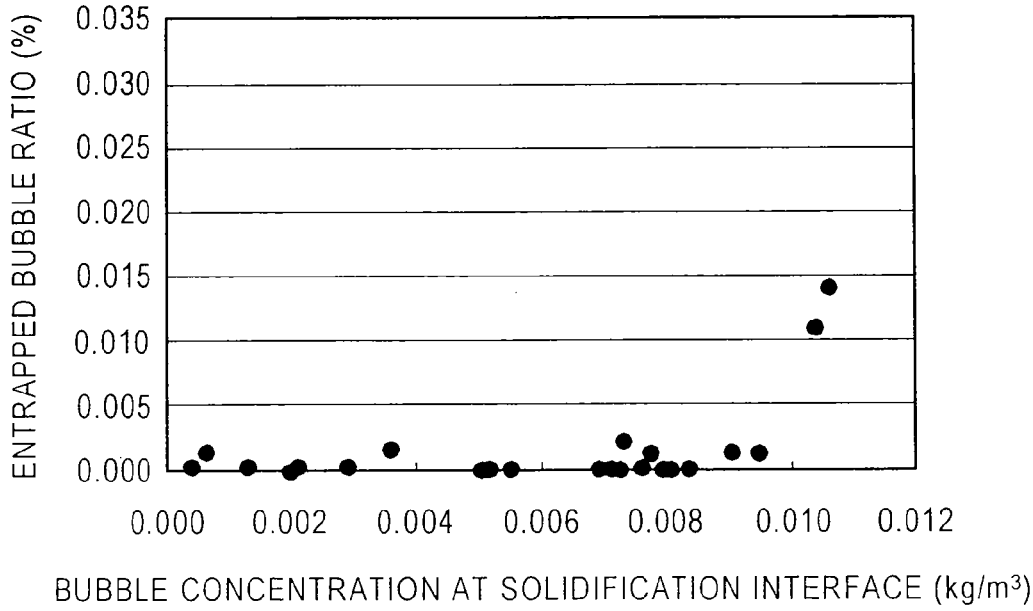
FIG. 11 is a graph showing the relationship between a bubble concentration at solidification interface (bubble concentration at molten steel-solidification shell interface) and an entrapped bubble ratio of the molten steel in the mold.

The bubble concentration at solidification interface significantly affects entrapment of bubbles. When the bubble concentration is high, the amount of bubbles trapped in the solidification shell is increased. FIG. 11 shows the relationship between the bubble concentration at solidification interface (horizontal axis: unit $kg/m^3$) and the entrapped bubble ratio (percentage (%) of bubbles entrapped from among bubbles scattered in the nozzle (vertical axis)). Other conditions were as follows: turbulence energy on top surface: 0.0020 to 0.0030 $m^2/s^2$, flow velocity on top surface: 0.05 to 0.30 m/s, and flow velocity at solidification interface: 0.14 to 0.20 m/s. According to FIG. 11, the amount of bubbles trapped in the solidification shell is suppressed to a low level at a bubble concentration at solidification interface of 0.01 $kg/m^3$ or less. Accordingly, the bubble concentration at solidification interface is preferably 0.01 $kg/m^3$ or less. The bubble concentration at solidification interface can be controlled by the slab thickness to be cast and the amount of inert gas blown from the inner wall surface of the immersion nozzle. The slab thickness to be cast is preferably 220 mm or more and the amount of the inert gas blown from the inner wall surface of the immersion nozzle is preferably 25 NL/min or less. The bubble concentration at solidification interface is preferably as low as possible and no particular lower limit is set.

The molten steel discharged from the molten steel spouts 20 of the immersion nozzle 2 is accompanied by bubbles. When the slab thickness is too small, the molten steel flow discharged from the molten steel spouts 20 approaches the solidification shell 5 at the mold long side portion side. Then the bubble concentration at solidification interface is increased, and the bubbles are readily trapped at the solidification shell interface. In particular, when the slab thickness is less than 220 mm, control of the bubble distribution is difficult even by implementing electromagnetic flow control of the molten steel flow as in aspects of the present invention due to the aforementioned reason. In contrast, when the slab thickness exceeds 300 mm, there is a drawback that the productivity of a hot rolling process is decreased. Accordingly, the slab thickness to be cast is preferably 220 to 300 mm.

When the amount of the inert gas blown from the inner wall surface of the immersion nozzle 2 is increased, the bubble concentration at solidification interface is increased and the bubbles are readily trapped at the solidification shell interface. In particular, when the amount of inert gas blown exceeds 20 NL/min, control of the bubble distribution is difficult even by implementing electromagnetic flow control of the molten steel flow as in aspects of the present invention due to the aforementioned reason. In contrast, when the amount of the inert gas blown is too small, nozzle clogging tends to occur and drift is enhanced. Thus the flow velocity is difficult to be controlled. Accordingly, the amount of the inert gas blown from the inner wall surface of the immersion nozzle 2 is preferably 3 to 25 NL/min. Moreover, when the frequency of the AC magnetic field applied to the upper magnetic poles is adequately increased, the change in flow over time induced by the magnetic field is decreased. Thus, disturbance of the molten steel top surface can be suppressed, the chances that the mold powder will remain unmelted or the chances of fluctuation of the bath surface caused by the disturbance can be reduced, and a higher slab quality can be achieved. In particular, when the frequency is 1.5 Hz or more, unmelted mold powder and the bath surface fluctuation can be significantly reduced. It has also been found that when the frequency is adequately decreased, heating of a mold copper plate or peripheral portions of the copper plate during application of the magnetic field can be suppressed and the chances that the mold is deformed can be reduced. In particular, when the frequency is 5.0 Hz or less, the chances of occurrence of deformation mentioned above are significantly decreased. In view of the above, the frequency is preferably 1.5 Hz or more and 5.0 Hz or less.

EXAMPLES

About 300 ton of aluminum killed molten steel was cast by a continuous casting method by using a continuous caster shown in FIGS. 2 and 3, that is, a continuous caster that includes a pair of upper magnetic poles (equipped with DC magnetic field magnetic poles and AC magnetic field magnetic poles that can be independently controlled) and a pair of lower magnetic poles disposed on mold outer sides (back surfaces of mold side walls), both the upper magnetic poles and the lower magnetic poles respectively facing each other with a mold long-side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with DC magnetic fields respectively applied to the pair of upper magnetic poles and the pair of lower magnetic poles and stirring molten steel with an AC magnetic field simultaneously applied to the pair of upper magnetic poles. Ar gas was used as an inert gas blown from the immersion nozzle and the amount of the Ar gas blown was adjusted within the range of 5 to 12 NL/min in accordance with the opening of a sliding nozzle to prevent nozzle clogging.

The specifications of the continuous caster and other casting conditions were as follows.

Shape of molten steel spouts of the immersion nozzle: rectangle 70 mm×80 mm in size.

Immersion nozzle inner diameter: 80 mm

Area of aperture of each molten steel spout of the immersion nozzle: 5600 $mm^2$ Viscosity of the mold flux used (1300° C.): 0.6 cp Frequency of the AC magnetic field applied to the upper magnetic poles: 3.3 Hz

Example 1

Continuous casting was conducted under conditions (slab width and casting speed) shown in Table 1 by using an immersion nozzle at an immersion depth (distance from the meniscus to the upper end of the molten steel spout) of 230 mm, the immersion nozzle including molten steel spouts each having a molten steel discharge angle of 35° downward from the horizontal direction while adjusting the strength of the AC magnetic field applied to the upper magnetic poles to 0.080 T, the strength of the DC magnetic field applied to the upper magnetic poles to 0.12 T, and the strength of the DC magnetic field applied to the lower magnetic poles to 0.38 T. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects and defects originating from steel making (flux defects and bubble defects) were identified from among the defects on the basis of the defect appearance, SEM analysis, ICP analysis, etc. Evaluation was conducted by the standard below on the basis of the number of defects per 100 m of the coil length. The results are also shown in Table 1.

A: The number of defects was 1.00 or less.

F: The number of defects was more than 1.00.

TABLE 1

| No | Type | Slab width (mm) | Casting speed (m/min) | Defects after Zn plating |
|---|---|---|---|---|
| 1 | Invention Example | 950 | 0.95 | A |
| 2 | Invention Example | 950 | 1.30 | A |
| 3 | Invention Example | 950 | 1.60 | A |
| 4 | Invention Example | 1045 | 1.30 | A |
| 5 | Invention Example | 1045 | 1.64 | A |
| 6 | Comparative Example | 950 | 1.70 | F |
| 7 | Comparative Example | 1045 | 1.70 | F |
| 8 | Invention Example | 1050 | 0.95 | A |
| 9 | Invention Example | 1050 | 1.40 | A |
| 10 | Invention Example | 1245 | 0.95 | A |
| 11 | Invention Example | 1245 | 1.44 | A |
| 12 | Comparative Example | 1050 | 1.50 | F |
| 13 | Comparative Example | 1245 | 1.50 | F |
| 14 | Invention Example | 1250 | 0.95 | A |
| 15 | Invention Example | 1250 | 1.20 | A |
| 16 | Invention Example | 1445 | 0.95 | A |
| 17 | Invention Example | 1445 | 1.24 | A |
| 18 | Comparative Example | 1250 | 1.30 | F |
| 19 | Comparative Example | 1445 | 1.30 | F |
| 20 | Invention Example | 1450 | 0.95 | A |
| 21 | Invention Example | 1450 | 1.00 | A |
| 22 | Invention Example | 1600 | 0.95 | A |
| 23 | Invention Example | 1600 | 1.00 | A |
| 24 | Invention Example | 1745 | 1.04 | A |
| 25 | Comparative Example | 1450 | 1.10 | F |
| 26 | Comparative Example | 1740 | 1.15 | F |

Example 2

Continuous casting was conducted under conditions (slab width and casting speed) shown in Table 2 by using an immersion nozzle at an immersion depth (distance from the meniscus to the upper end of the molten steel spout) of 230 mm, the immersion nozzle including molten steel spouts each having a molten steel discharge angle of 35° downward from the horizontal direction while adjusting the strength of the AC magnetic field applied to the upper magnetic poles to 0.080 T, the strength of the DC magnetic field applied to the upper magnetic poles to 0.24 T, and the strength of the DC magnetic field applied to the lower magnetic poles to 0.38 T. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects and defects originating from steel making (flux defects and bubble defects) were identified from among the defects on the basis of the defect appearance, SEM analysis, ICP analysis, etc. Evaluation was conducted by the standard below on the basis of the number of defects per 100 m of the coil length. The results are also shown in Table 2.

A: The number of defects was 1.00 or less.

F: The number of defects was more than 1.00.

TABLE 2

| No | Type | Slab width (mm) | Casting speed (m/min) | Defects after Zn plating |
|---|---|---|---|---|
| 1 | Invention Example | 1050 | 1.45 | A |
| 2 | Invention Example | 1050 | 1.80 | A |
| 3 | Invention Example | 1050 | 2.20 | A |
| 4 | Invention Example | 1145 | 1.45 | A |
| 5 | Invention Example | 1145 | 2.24 | A |
| 6 | Comparative Example | 1145 | 1.35 | F |
| 7 | Comparative Example | 1145 | 2.35 | F |
| 8 | Invention Example | 1150 | 1.45 | A |
| 9 | Invention Example | 1150 | 1.70 | A |
| 10 | Invention Example | 1150 | 2.00 | A |
| 11 | Invention Example | 1240 | 1.45 | A |
| 12 | Invention Example | 1245 | 2.04 | A |
| 13 | Comparative Example | 1240 | 1.35 | F |
| 14 | Comparative Example | 1240 | 2.15 | F |
| 15 | Invention Example | 1250 | 1.25 | A |
| 16 | Invention Example | 1250 | 1.70 | A |
| 17 | Invention Example | 1250 | 2.00 | A |
| 18 | Invention Example | 1340 | 1.25 | A |
| 19 | Invention Example | 1345 | 2.04 | A |
| 20 | Comparative Example | 1340 | 1.15 | F |
| 21 | Comparative Example | 1340 | 2.15 | F |
| 22 | Invention Example | 1350 | 1.25 | A |
| 23 | Invention Example | 1350 | 1.50 | A |
| 24 | Invention Example | 1350 | 1.80 | A |
| 25 | Invention Example | 1440 | 1.25 | A |
| 26 | Invention Example | 1445 | 1.84 | A |
| 27 | Comparative Example | 1440 | 1.15 | F |
| 28 | Comparative Example | 1440 | 1.90 | F |
| 29 | Invention Example | 1450 | 1.05 | A |
| 30 | Invention Example | 1550 | 1.30 | A |
| 31 | Invention Example | 1450 | 1.60 | A |
| 32 | Invention Example | 1740 | 1.05 | A |
| 33 | Invention Example | 1745 | 1.64 | A |
| 34 | Comparative Example | 1450 | 0.95 | F |
| 35 | Comparative Example | 1740 | 0.95 | F |
| 36 | Comparative Example | 1450 | 1.70 | F |
| 37 | Comparative Example | 1740 | 1.70 | F |

Example 3

Continuous casting was conducted under conditions (slab width and casting speed) shown in Table 3 by using an immersion nozzle at an immersion depth (distance from the meniscus to the upper end of the molten steel spout) of 230 mm, the immersion nozzle including molten steel spouts each having a molten steel discharge angle of 35° downward from the horizontal direction while adjusting the strength of the AC magnetic field applied to the upper magnetic poles to 0.080 T, the strength of the DC magnetic field applied to the upper magnetic poles to 0.29 T, and the strength of the DC magnetic field applied to the lower magnetic poles to 0.38 T. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects and defects originating from steel making (flux defects and bubble defects) were identified from among the defects on the basis of the defect appearance, SEM analysis, ICP analysis, etc. Evaluation was conducted by the standard below on the basis of the number of defects per 100 m of the coil length. The results are also shown in Table 3.

A: The number of defects was 1.00 or less.

F: The number of defects was more than 1.00.

TABLE 3

| No | Type | Slab width (mm) | Casting speed (m/min) | Defects after Zn plating |
|---|---|---|---|---|
| 1 | Invention Example | 1050 | 2.25 | A |
| 2 | Invention Example | 1050 | 2.60 | A |
| 3 | Invention Example | 1140 | 2.25 | A |
| 4 | Invention Example | 1145 | 2.64 | A |
| 5 | Comparative Example | 1050 | 2.15 | F |
| 6 | Invention Example | 1150 | 2.05 | A |
| 7 | Invention Example | 1150 | 2.60 | A |
| 8 | Invention Example | 1340 | 2.05 | A |
| 9 | Invention Example | 1345 | 2.64 | A |
| 10 | Comparative Example | 1150 | 1.95 | F |
| 11 | Comparative Example | 1340 | 1.95 | F |
| 12 | Invention Example | 1350 | 1.85 | A |
| 13 | Invention Example | 1350 | 2.40 | A |
| 14 | Invention Example | 1440 | 1.85 | A |
| 15 | Invention Example | 1445 | 2.44 | A |
| 16 | Comparative Example | 1350 | 1.80 | F |
| 17 | Comparative Example | 1440 | 1.80 | F |
| 18 | Invention Example | 1450 | 1.65 | A |
| 19 | Invention Example | 1450 | 2.30 | A |
| 20 | Invention Example | 1540 | 1.65 | A |
| 21 | Invention Example | 1545 | 2.34 | A |
| 22 | Comparative Example | 1450 | 1.60 | F |
| 23 | Comparative Example | 1540 | 1.60 | F |
| 24 | Invention Example | 1550 | 1.65 | A |
| 25 | Invention Example | 1550 | 2.20 | A |
| 26 | Invention Example | 1640 | 1.65 | A |
| 27 | Invention Example | 1645 | 2.24 | A |
| 28 | Comparative Example | 1550 | 1.60 | F |
| 29 | Comparative Example | 1640 | 1.60 | F |
| 30 | Invention Example | 1650 | 1.65 | A |
| 31 | Invention Example | 1650 | 2.10 | A |
| 32 | Invention Example | 1740 | 1.65 | A |
| 33 | Invention Example | 1745 | 2.14 | A |
| 34 | Comparative Example | 1650 | 1.55 | F |
| 35 | Comparative Example | 1740 | 1.60 | F |

Example 4

Continuous casting was conducted under conditions (slab width and casting speed) shown in Table 4 by using an immersion nozzle at an immersion depth (distance from the meniscus to the upper end of the molten steel spout) of 260 mm, the immersion nozzle including molten steel spouts each having a molten steel discharge angle of 35° downward from the horizontal direction while adjusting the strength of the AC magnetic field applied to the upper magnetic poles to 0.080 T, the strength of the DC magnetic field applied to the upper magnetic poles to 0.12 T, and the strength of the DC magnetic field applied to the lower magnetic poles to 0.38 T. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects and defects originating from steel making (flux defects and bubble defects) were identified from among the defects on the basis of the defect appearance, SEM analysis, ICP analysis, etc. Evaluation was conducted by the standard below on the basis of the number of defects per 100 m of the coil length. The results are also shown in Table 4.

A: The number of defects was 1.00 or less.

F: The number of defects was more than 1.00.

TABLE 4

| No | Type | Slab width (mm) | Casting speed (m/min) | Defects after Zn plating |
|---|---|---|---|---|
| 1 | Invention Example | 950 | 0.95 | A |
| 2 | Invention Example | 950 | 1.30 | A |
| 3 | Invention Example | 950 | 1.60 | A |
| 4 | Invention Example | 1045 | 1.30 | A |
| 5 | Invention Example | 1045 | 1.64 | A |
| 6 | Comparative Example | 950 | 1.70 | F |
| 7 | Comparative Example | 1045 | 1.70 | F |
| 8 | Invention Example | 1050 | 0.95 | A |
| 9 | Invention Example | 1050 | 1.40 | A |
| 10 | Invention Example | 1245 | 0.95 | A |
| 11 | Invention Example | 1245 | 1.44 | A |
| 12 | Comparative Example | 1050 | 1.50 | F |
| 13 | Comparative Example | 1245 | 1.50 | F |
| 14 | Invention Example | 1250 | 0.95 | A |
| 15 | Invention Example | 1250 | 1.20 | A |
| 16 | Invention Example | 1445 | 0.95 | A |
| 17 | Invention Example | 1445 | 1.24 | A |
| 18 | Comparative Example | 1250 | 1.30 | F |
| 19 | Comparative Example | 1445 | 1.30 | F |
| 20 | Invention Example | 1450 | 0.95 | A |
| 21 | Invention Example | 1450 | 1.00 | A |
| 22 | Invention Example | 1600 | 0.95 | A |
| 23 | Invention Example | 1600 | 1.00 | A |
| 24 | Invention Example | 1745 | 1.04 | A |
| 25 | Comparative Example | 1450 | 1.10 | F |
| 26 | Comparative Example | 1740 | 1.15 | F |

Example 5

Continuous casting was conducted under conditions (slab width and casting speed) shown in Table 5 by using an immersion nozzle at an immersion depth (distance from the meniscus to the upper end of the molten steel spout) of 260 mm, the immersion nozzle including molten steel spouts each having a molten steel discharge angle of 35° downward from the horizontal direction while adjusting the strength of the AC magnetic field applied to the upper magnetic poles to 0.080 T, the strength of the DC magnetic field applied to the upper magnetic poles to 0.24 T, and the strength of the DC magnetic field applied to the lower magnetic poles to 0.38 T. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects and defects originating from steel making (flux defects and bubble defects) were identified from among the defects on the basis of the defect appearance, SEM analysis, ICP analysis, etc. Evaluation was conducted by the standard below on the basis of the number of defects per 100 m of the coil length. The results are also shown in Table 5.

A: The number of defects was 1.00 or less.

F: The number of defects was more than 1.00.

TABLE 5

| No | Type | Slab width (mm) | Casting speed (m/min) | Defects after Zn plating |
|---|---|---|---|---|
| 1 | Invention Example | 1050 | 1.45 | A |
| 2 | Invention Example | 1050 | 1.90 | A |
| 3 | Invention Example | 1050 | 2.40 | A |
| 4 | Invention Example | 1145 | 1.45 | A |
| 5 | Invention Example | 1145 | 2.44 | A |
| 6 | Comparative Example | 1145 | 1.35 | F |
| 7 | Comparative Example | 1145 | 2.50 | F |

TABLE 5-continued

| No | Type | Slab width (mm) | Casting speed (m/min) | Defects after Zn plating |
|---|---|---|---|---|
| 8 | Invention Example | 1150 | 1.45 | A |
| 9 | Invention Example | 1150 | 1.80 | A |
| 10 | Invention Example | 1150 | 2.20 | A |
| 11 | Invention Example | 1240 | 1.45 | A |
| 12 | Invention Example | 1245 | 2.24 | A |
| 13 | Comparative Example | 1240 | 1.35 | F |
| 14 | Comparative Example | 1240 | 2.35 | F |
| 15 | Invention Example | 1250 | 1.25 | A |
| 16 | Invention Example | 1250 | 1.70 | A |
| 17 | Invention Example | 1250 | 2.00 | A |
| 18 | Invention Example | 1340 | 1.25 | A |
| 19 | Invention Example | 1345 | 2.04 | A |
| 20 | Comparative Example | 1340 | 1.15 | F |
| 21 | Comparative Example | 1340 | 2.15 | F |
| 22 | Invention Example | 1350 | 1.25 | A |
| 23 | Invention Example | 1350 | 1.50 | A |
| 24 | Invention Example | 1350 | 1.80 | A |
| 25 | Invention Example | 1440 | 1.25 | A |
| 26 | Invention Example | 1445 | 1.84 | A |
| 27 | Comparative Example | 1440 | 1.15 | F |
| 28 | Comparative Example | 1440 | 1.90 | F |
| 29 | Invention Example | 1450 | 1.05 | A |
| 30 | Invention Example | 1450 | 1.50 | A |
| 31 | Invention Example | 1450 | 1.80 | A |
| 32 | Invention Example | 1540 | 1.05 | A |
| 33 | Invention Example | 1545 | 1.84 | A |
| 34 | Comparative Example | 1540 | 0.95 | F |
| 35 | Comparative Example | 1540 | 1.90 | F |
| 36 | Invention Example | 1550 | 1.05 | A |
| 37 | Invention Example | 1550 | 1.60 | A |
| 38 | Invention Example | 1630 | 1.05 | A |
| 39 | Invention Example | 1740 | 1.05 | A |
| 40 | Invention Example | 1745 | 1.64 | A |
| 41 | Comparative Example | 1550 | 0.95 | F |
| 42 | Comparative Example | 1740 | 0.95 | F |
| 43 | Comparative Example | 1550 | 1.70 | F |
| 44 | Comparative Example | 1740 | 1.70 | F |

Example 6

Continuous casting was conducted under conditions (slab width and casting speed) shown in Table 6 by using an immersion nozzle at an immersion depth (distance from the meniscus to the upper end of the molten steel spout) of 260 mm, the immersion nozzle including molten steel spouts each having a molten steel discharge angle of 35° downward from the horizontal direction while adjusting the strength of the AC magnetic field applied to the upper magnetic poles to 0.080 T, the strength of the DC magnetic field applied to the upper magnetic poles to 0.29 T, and the strength of the DC magnetic field applied to the lower magnetic poles to 0.38 T. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects and defects originating from steel making (flux defects and bubble defects) were identified from among the defects on the basis of the defect appearance, SEM analysis, ICP analysis, etc. Evaluation was conducted by the standard below on the basis of the number of defects per 100 m of the coil length. The results are also shown in Table 6.

A: The number of defects was 1.00 or less.

F: The number of defects was more than 1.00.

TABLE 6

| No | Type | Slab width (mm) | Casting speed (m/min) | Defects after Zn plating |
|---|---|---|---|---|
| 1 | Invention Example | 1050 | 2.45 | A |
| 2 | Invention Example | 1050 | 2.60 | A |
| 3 | Invention Example | 1140 | 2.45 | A |
| 4 | Invention Example | 1145 | 2.64 | A |
| 5 | Comparative Example | 1050 | 2.35 | F |
| 6 | Comparative Example | 1140 | 2.30 | F |
| 7 | Invention Example | 1150 | 2.25 | A |
| 8 | Invention Example | 1150 | 2.60 | A |
| 9 | Invention Example | 1240 | 2.25 | A |
| 10 | Invention Example | 1245 | 2.64 | A |
| 11 | Comparative Example | 1150 | 2.15 | F |
| 12 | Comparative Example | 1240 | 2.15 | F |
| 13 | Invention Example | 1250 | 2.05 | A |
| 14 | Invention Example | 1250 | 2.60 | A |
| 15 | Invention Example | 1340 | 2.05 | A |
| 16 | Invention Example | 1345 | 2.64 | A |
| 17 | Comparative Example | 1250 | 1.95 | F |
| 18 | Comparative Example | 1340 | 1.95 | F |
| 19 | Invention Example | 1350 | 1.85 | A |
| 20 | Invention Example | 1350 | 2.40 | A |
| 21 | Invention Example | 1440 | 1.85 | A |
| 22 | Invention Example | 1445 | 2.44 | A |
| 23 | Comparative Example | 1350 | 1.75 | F |
| 24 | Comparative Example | 1440 | 1.80 | F |
| 25 | Invention Example | 1450 | 1.85 | A |
| 26 | Invention Example | 1450 | 2.30 | A |
| 27 | Invention Example | 1540 | 1.85 | A |
| 28 | Invention Example | 1545 | 2.34 | A |
| 29 | Comparative Example | 1450 | 1.75 | F |
| 30 | Comparative Example | 1540 | 1.80 | F |
| 31 | Invention Example | 1550 | 1.65 | A |
| 32 | Invention Example | 1550 | 2.20 | A |
| 33 | Invention Example | 1640 | 1.65 | A |
| 34 | Invention Example | 1645 | 2.24 | A |
| 35 | Comparative Example | 1550 | 1.60 | F |
| 36 | Comparative Example | 1640 | 1.60 | F |
| 37 | Invention Example | 1650 | 1.65 | A |
| 38 | Invention Example | 1650 | 2.10 | A |
| 39 | Invention Example | 1740 | 1.65 | A |
| 40 | Invention Example | 1745 | 2.14 | A |
| 41 | Comparative Example | 1650 | 1.55 | F |
| 42 | Comparative Example | 1740 | 1.60 | F |

Example 7

Continuous casting was conducted under conditions (slab width and casting speed) shown in Table 7 by using an immersion nozzle at an immersion depth (distance from the meniscus to the upper end of the molten steel spout) of 290 mm, the immersion nozzle including molten steel spouts each having a molten steel discharge angle of 35° downward from the horizontal direction while adjusting the strength of the AC magnetic field applied to the upper magnetic poles to 0.080 T, the strength of the DC magnetic field applied to the upper magnetic poles to 0.12 T, and the strength of the DC magnetic field applied to the lower magnetic poles to 0.38 T. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects and defects originating from steel making (flux defects and bubble defects) were identified from among the defects on the basis of the defect appearance, SEM analysis, ICP analysis, etc. Evaluation was conducted by the standard below on the basis of the number of defects per 100 m of the coil length. The results are also shown in Table 7.

A: The number of defects was 1.00 or less.

F: The number of defects was more than 1.00.

TABLE 7

| No | Type | Slab width (mm) | Casting speed (m/min) | Defects after Zn plating |
|---|---|---|---|---|
| 1 | Invention Example | 950 | 0.95 | A |
| 2 | Invention Example | 950 | 1.30 | A |
| 3 | Invention Example | 950 | 1.60 | A |
| 4 | Invention Example | 1045 | 1.30 | A |
| 5 | Invention Example | 1045 | 1.64 | A |
| 6 | Comparative Example | 950 | 1.70 | F |
| 7 | Comparative Example | 1045 | 1.70 | F |
| 8 | Invention Example | 1050 | 0.95 | A |
| 9 | Invention Example | 1050 | 1.40 | A |
| 10 | Invention Example | 1245 | 0.95 | A |
| 11 | Invention Example | 1245 | 1.44 | A |
| 12 | Comparative Example | 1050 | 1.50 | F |
| 13 | Comparative Example | 1245 | 1.50 | F |
| 14 | Invention Example | 1250 | 0.95 | A |
| 15 | Invention Example | 1250 | 1.20 | A |
| 16 | Invention Example | 1445 | 0.95 | A |
| 17 | Invention Example | 1445 | 1.24 | A |
| 18 | Comparative Example | 1250 | 1.30 | F |
| 19 | Comparative Example | 1445 | 1.30 | F |
| 20 | Invention Example | 1450 | 0.95 | A |
| 21 | Invention Example | 1450 | 1.00 | A |
| 22 | Invention Example | 1600 | 0.95 | A |
| 23 | Invention Example | 1600 | 1.00 | A |
| 24 | Invention Example | 1745 | 1.04 | A |
| 25 | Comparative Example | 1450 | 1.10 | F |
| 26 | Comparative Example | 1740 | 1.15 | F |

Example 8

Continuous casting was conducted under conditions (slab width and casting speed) shown in Table 8 by using an immersion nozzle at an immersion depth (distance from the meniscus to the upper end of the molten steel spout) of 290 mm, the immersion nozzle including molten steel spouts each having a molten steel discharge angle of 35° downward from the horizontal direction while adjusting the strength of the AC magnetic field applied to the upper magnetic poles to 0.080 T, the strength of the DC magnetic field applied to the upper magnetic poles to 0.24 T, and the strength of the DC magnetic field applied to the lower magnetic poles to 0.38 T. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects and defects originating from steel making (flux defects and bubble defects) were identified from among the defects on the basis of the defect appearance, SEM analysis, ICP analysis, etc. Evaluation was conducted by the standard below on the basis of the number of defects per 100 m of the coil length. The results are also shown in Table 8.

A: The number of defects was 1.00 or less.

F: The number of defects was more than 1.00.

TABLE 8

| No | Type | Slab width (mm) | Casting speed (m/min) | Defects after Zn plating |
|---|---|---|---|---|
| 1 | Invention Example | 1050 | 1.45 | A |
| 2 | Invention Example | 1050 | 1.80 | A |
| 3 | Invention Example | 1050 | 2.60 | A |
| 4 | Invention Example | 1145 | 1.45 | A |
| 5 | Invention Example | 1145 | 2.64 | A |
| 6 | Comparative Example | 1145 | 1.35 | F |
| 7 | Invention Example | 1150 | 1.45 | A |

TABLE 8-continued

| No | Type | Slab width (mm) | Casting speed (m/min) | Defects after Zn plating |
|---|---|---|---|---|
| 8 | Invention Example | 1150 | 1.70 | A |
| 9 | Invention Example | 1150 | 2.20 | A |
| 10 | Invention Example | 1240 | 1.45 | A |
| 11 | Invention Example | 1245 | 2.24 | A |
| 12 | Comparative Example | 1240 | 1.35 | F |
| 13 | Comparative Example | 1240 | 2.35 | F |
| 14 | Invention Example | 1250 | 1.25 | A |
| 15 | Invention Example | 1250 | 1.70 | A |
| 16 | Invention Example | 1250 | 2.20 | A |
| 17 | Invention Example | 1340 | 1.25 | A |
| 18 | Invention Example | 1345 | 2.24 | A |
| 19 | Comparative Example | 1340 | 1.15 | F |
| 20 | Comparative Example | 1340 | 2.35 | F |
| 21 | Invention Example | 1350 | 1.25 | A |
| 22 | Invention Example | 1350 | 1.50 | A |
| 23 | Invention Example | 1350 | 2.00 | A |
| 24 | Invention Example | 1440 | 1.25 | A |
| 25 | Invention Example | 1445 | 2.04 | A |
| 26 | Comparative Example | 1440 | 1.15 | F |
| 27 | Comparative Example | 1440 | 2.10 | F |
| 28 | Invention Example | 1450 | 1.05 | A |
| 29 | Invention Example | 1550 | 1.30 | A |
| 30 | Invention Example | 1450 | 1.80 | A |
| 31 | Invention Example | 1640 | 1.05 | A |
| 32 | Invention Example | 1645 | 1.84 | A |
| 33 | Comparative Example | 1450 | 0.95 | F |
| 34 | Comparative Example | 1640 | 0.95 | F |
| 35 | Comparative Example | 1450 | 1.90 | F |
| 36 | Comparative Example | 1640 | 1.90 | F |
| 37 | Invention Example | 1650 | 1.05 | A |
| 38 | Invention Example | 1650 | 1.60 | A |
| 39 | Invention Example | 1740 | 1.05 | A |
| 40 | Invention Example | 1745 | 1.64 | A |
| 41 | Comparative Example | 1740 | 0.95 | F |
| 42 | Comparative Example | 1740 | 1.70 | F |

Example 9

Continuous casting was conducted under conditions (slab width and casting speed) shown in Table 9 by using an immersion nozzle at an immersion depth (distance from the meniscus to the upper end of the molten steel spout) of 290 mm, the immersion nozzle including molten steel spouts each having a molten steel discharge angle of 35° downward from the horizontal direction while adjusting the strength of the AC magnetic field applied to the upper magnetic poles to 0.080 T, the strength of the DC magnetic field applied to the upper magnetic poles to 0.29 T, and the strength of the DC magnetic field applied to the lower magnetic poles to 0.38 T. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects and defects originating from steel making (flux defects and bubble defects) were identified from among the defects on the basis of the defect appearance, SEM analysis, ICP analysis, etc. Evaluation was conducted by the standard below on the basis of the number of defects per 100 m of the coil length. The results are also shown in Table 9.

A: The number of defects was 1.00 or less.

F: The number of defects was more than 1.00.

TABLE 9

| No | Type | Slab width (mm) | Casting speed (m/min) | Defects after Zn plating |
|---|---|---|---|---|
| 1 | Invention Example | 1150 | 2.25 | A |
| 2 | Invention Example | 1150 | 2.60 | A |
| 3 | Invention Example | 1340 | 2.25 | A |
| 4 | Invention Example | 1345 | 2.64 | A |
| 5 | Comparative Example | 1150 | 2.15 | F |
| 6 | Comparative Example | 1340 | 2.15 | F |
| 7 | Invention Example | 1350 | 2.05 | A |
| 8 | Invention Example | 1350 | 2.60 | A |
| 9 | Invention Example | 1440 | 2.05 | A |
| 10 | Invention Example | 1445 | 2.64 | A |
| 11 | Comparative Example | 1350 | 1.95 | F |
| 12 | Comparative Example | 1440 | 2.00 | F |
| 13 | Invention Example | 1450 | 1.85 | A |
| 14 | Invention Example | 1450 | 2.30 | A |
| 15 | Invention Example | 1540 | 1.85 | A |
| 16 | Invention Example | 1545 | 2.34 | A |
| 17 | Comparative Example | 1450 | 1.75 | F |
| 18 | Comparative Example | 1540 | 1.80 | F |
| 19 | Invention Example | 1550 | 1.85 | A |
| 20 | Invention Example | 1550 | 2.20 | A |
| 21 | Invention Example | 1640 | 1.85 | A |
| 22 | Invention Example | 1645 | 2.24 | A |
| 23 | Comparative Example | 1550 | 1.80 | F |
| 24 | Comparative Example | 1640 | 1.80 | F |
| 25 | Invention Example | 1650 | 1.65 | A |
| 26 | Invention Example | 1650 | 2.10 | A |
| 27 | Invention Example | 1740 | 1.65 | A |
| 28 | Invention Example | 1745 | 2.14 | A |
| 29 | Comparative Example | 1650 | 1.55 | F |
| 30 | Comparative Example | 1740 | 1.60 | F |

Example 10

Continuous casting was conducted under conditions for applying magnetic fields shown in Tables 10 to 14. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects, and flux defects and bubble defects were identified from among the defects on the basis of the defect form (defect appearance), SEM analysis, ICP analysis, etc. Evaluation was conducted by the standard below on the basis of the number of defects per 100 m of the coil length.

AA: The number of defects was 0.30 or less.

A: The number of defects was more than 0.30 and 1.00 or less.

F: The number of defects was more than 1.00.

On the basis of these results, the "defects after Zn plating" were comprehensively evaluated as follows.

AA: Both flux defects and bubble defects were rated AA.

A: One of flux defects and bubble defects was rated AA and the other was rated A.

F: At least one of flux defects and bubble defects was rated F.

The results are also shown in Tables 10 to 14.

TABLE 10

| No. | Type | Molten steel discharge angle of immersion nozzle (°) | Immersion depth of immersion nozzle (mm) | Strength of AC magnetic field (T) | Strength of DC magnetic field (T) Upper magnetic poles | Strength of DC magnetic field (T) Lower magnetic poles | Defects originating from steel making Flux defects | Defects originating from steel making Bubble defects | Defects after Zn plating | Other casting conditions Casting speed (m/min) | Other casting conditions Slab width (mm) |
|---|---|---|---|---|---|---|---|---|---|---|---|
| 1 | Invention Example | 35 | 230 | 0.070 | 0.02 | 0.38 | A | AA | A | 1.00 to 1.20 | 1000 to 1400 |
| 2 | Invention Example | 35 | 230 | 0.070 | 0.12 | 0.38 | AA | AA | AA | | |
| 3 | Invention Example | 35 | 230 | 0.070 | 0.18 | 0.38 | AA | A | A | | |
| 4 | Invention Example | 35 | 230 | 0.070 | 0.12 | 0.30 | AA | A | A | | |
| 5 | Invention Example | 35 | 230 | 0.070 | 0.12 | 0.45 | AA | A | A | | |
| 6 | Invention Example | 35 | 230 | 0.060 | 0.12 | 0.38 | AA | A | A | | |
| 7 | Invention Example | 35 | 230 | 0.090 | 0.12 | 0.38 | A | AA | A | | |
| 8 | Comparative Example | 35 | 230 | 0.090 | 0.01 | 0.38 | F | AA | F | | |
| 9 | Comparative Example | 35 | 230 | 0.070 | 0.19 | 0.38 | A | F | F | | |
| 10 | Comparative Example | 35 | 230 | 0.070 | 0.12 | 0.25 | AA | F | F | | |
| 11 | Comparative Example | 35 | 230 | 0.070 | 0.12 | 0.50 | AA | F | F | | |
| 12 | Comparative Example | 35 | 230 | 0.055 | 0.12 | 0.38 | AA | F | F | | |
| 13 | Comparative Example | 35 | 230 | 0.095 | 0.12 | 0.38 | F | AA | F | | |
| 14 | Invention Example | 35 | 230 | 0.070 | 0.19 | 0.38 | A | AA | A | 1.60 to 1.80 | 1100 to 1300 |
| 15 | Invention Example | 35 | 230 | 0.070 | 0.22 | 0.38 | AA | AA | AA | | |
| 16 | Invention Example | 35 | 230 | 0.070 | 0.25 | 0.38 | AA | A | A | | |
| 17 | Invention Example | 35 | 230 | 0.070 | 0.22 | 0.30 | AA | A | A | | |
| 18 | Invention Example | 35 | 230 | 0.070 | 0.22 | 0.45 | AA | A | A | | |
| 19 | Invention Example | 35 | 230 | 0.060 | 0.22 | 0.38 | AA | A | A | | |
| 20 | Invention Example | 35 | 230 | 0.090 | 0.22 | 0.38 | A | AA | A | | |
| 21 | Comparative Example | 35 | 230 | 0.070 | 0.17 | 0.38 | F | AA | F | | |
| 22 | Comparative Example | 35 | 230 | 0.070 | 0.27 | 0.38 | AA | F | F | | |
| 23 | Comparative Example | 35 | 230 | 0.070 | 0.22 | 0.25 | AA | F | F | | |
| 24 | Comparative Example | 35 | 230 | 0.070 | 0.22 | 0.50 | AA | F | F | | |
| 25 | Comparative Example | 35 | 230 | 0.055 | 0.22 | 0.38 | AA | F | F | | |
| 26 | Comparative Example | 35 | 230 | 0.095 | 0.22 | 0.38 | F | AA | F | | |

TABLE 11

| No. | Type | Molten steel discharge angle of immersion nozzle (°) | Immersion depth of immersion nozzle (mm) | Strength of AC magnetic field (T) | Strength of DC magnetic field (T) Upper magnetic poles | Strength of DC magnetic field (T) Lower magnetic poles | Defects originating from steel making Flux defects | Defects originating from steel making Bubble defects | Defects after Zn plating | Other casting conditions Casting speed (m/min) | Other casting conditions Slab width (mm) |
|---|---|---|---|---|---|---|---|---|---|---|---|
| 27 | Invention Example | 35 | 230 | 0.070 | 0.26 | 0.38 | A | AA | A | 2.00 to 2.10 | 1400 to 1700 |
| 28 | Invention Example | 35 | 230 | 0.070 | 0.30 | 0.38 | AA | AA | AA | | |
| 29 | Invention Example | 35 | 230 | 0.070 | 0.35 | 0.38 | AA | A | A | | |
| 30 | Invention Example | 35 | 230 | 0.070 | 0.30 | 0.30 | AA | A | A | | |
| 31 | Invention Example | 35 | 230 | 0.070 | 0.30 | 0.45 | AA | A | A | | |
| 32 | Invention Example | 35 | 230 | 0.060 | 0.30 | 0.38 | AA | A | A | | |
| 33 | Invention Example | 35 | 230 | 0.090 | 0.30 | 0.38 | A | AA | A | | |
| 34 | Comparative Example | 35 | 230 | 0.070 | 0.24 | 0.38 | F | AA | F | | |
| 35 | Comparative Example | 35 | 230 | 0.070 | 0.37 | 0.38 | AA | F | F | | |
| 36 | Comparative Example | 35 | 230 | 0.070 | 0.30 | 0.25 | AA | F | F | | |
| 37 | Comparative Example | 35 | 230 | 0.070 | 0.30 | 0.50 | AA | F | F | | |
| 38 | Comparative Example | 35 | 230 | 0.055 | 0.30 | 0.38 | AA | F | F | | |
| 39 | Comparative Example | 35 | 230 | 0.095 | 0.30 | 0.38 | F | AA | F | | |
| 40 | Invention Example | 35 | 260 | 0.070 | 0.02 | 0.38 | A | AA | A | 1.00 to 1.20 | 1000 to 1400 |
| 41 | Invention Example | 35 | 260 | 0.070 | 0.12 | 0.38 | AA | AA | AA | | |
| 42 | Invention Example | 35 | 260 | 0.070 | 0.18 | 0.38 | AA | A | A | | |
| 43 | Invention Example | 35 | 260 | 0.070 | 0.12 | 0.30 | AA | A | A | | |
| 44 | Invention Example | 35 | 260 | 0.070 | 0.12 | 0.45 | AA | A | A | | |
| 45 | Invention Example | 35 | 260 | 0.060 | 0.12 | 0.38 | AA | A | A | | |
| 46 | Invention Example | 35 | 260 | 0.090 | 0.12 | 0.38 | A | AA | A | | |
| 47 | Comparative Example | 35 | 260 | 0.090 | 0.01 | 0.38 | F | AA | F | | |
| 48 | Comparative Example | 35 | 260 | 0.070 | 0.19 | 0.38 | A | F | F | | |
| 49 | Comparative Example | 35 | 260 | 0.070 | 0.12 | 0.25 | AA | F | F | | |
| 50 | Comparative Example | 35 | 260 | 0.070 | 0.12 | 0.50 | AA | F | F | | |
| 51 | Comparative Example | 35 | 260 | 0.055 | 0.12 | 0.38 | AA | F | F | | |
| 52 | Comparative Example | 35 | 260 | 0.095 | 0.12 | 0.38 | F | AA | F | | |

TABLE 12

| No. | Type | Molten steel discharge angle of immersion nozzle (°) | Immersion depth of immersion nozzle (mm) | Strength of AC magnetic field (T) | Strength of DC magnetic field (T) Upper magnetic poles | Strength of DC magnetic field (T) Lower magnetic poles | Defects originating from steel making Flux defects | Defects originating from steel making Bubble defects | Defects after Zn plating | Other casting conditions Casting speed (m/min) | Other casting conditions Slab width (mm) |
|---|---|---|---|---|---|---|---|---|---|---|---|
| 53 | Invention Example | 35 | 260 | 0.070 | 0.19 | 0.38 | A | AA | A | 1.60 to 2.00 | 1100 to 1300 |
| 54 | Invention Example | 35 | 260 | 0.070 | 0.22 | 0.38 | AA | AA | AA | | |
| 55 | Invention Example | 35 | 260 | 0.070 | 0.25 | 0.38 | AA | A | A | | |
| 56 | Invention Example | 35 | 260 | 0.070 | 0.22 | 0.30 | AA | A | A | | |
| 57 | Invention Example | 35 | 260 | 0.070 | 0.22 | 0.45 | AA | A | A | | |
| 58 | Invention Example | 35 | 260 | 0.060 | 0.22 | 0.38 | AA | A | A | | |
| 59 | Invention Example | 35 | 260 | 0.090 | 0.22 | 0.38 | A | AA | A | | |
| 60 | Comparative Example | 35 | 260 | 0.070 | 0.17 | 0.38 | F | AA | F | | |
| 61 | Comparative Example | 35 | 260 | 0.070 | 0.27 | 0.38 | AA | F | F | | |
| 62 | Comparative Example | 35 | 260 | 0.070 | 0.22 | 0.25 | AA | F | F | | |
| 63 | Comparative Example | 35 | 260 | 0.070 | 0.22 | 0.50 | AA | F | F | | |
| 64 | Comparative Example | 35 | 260 | 0.055 | 0.22 | 0.38 | AA | F | F | | |
| 65 | Comparative Example | 35 | 260 | 0.095 | 0.22 | 0.38 | F | AA | F | | |
| 66 | Invention Example | 35 | 260 | 0.070 | 0.26 | 0.38 | A | AA | A | 2.00 to 2.10 | 1400 to 1700 |
| 67 | Invention Example | 35 | 260 | 0.070 | 0.30 | 0.38 | AA | AA | AA | | |
| 68 | Invention Example | 35 | 260 | 0.070 | 0.35 | 0.38 | AA | A | A | | |
| 69 | Invention Example | 35 | 260 | 0.070 | 0.30 | 0.30 | AA | A | A | | |
| 70 | Invention Example | 35 | 260 | 0.070 | 0.30 | 0.45 | AA | A | A | | |
| 71 | Invention Example | 35 | 260 | 0.060 | 0.30 | 0.38 | AA | A | A | | |
| 72 | Invention Example | 35 | 260 | 0.090 | 0.30 | 0.38 | A | AA | A | | |
| 73 | Comparative Example | 35 | 260 | 0.070 | 0.24 | 0.38 | F | AA | F | | |
| 74 | Comparative Example | 35 | 260 | 0.070 | 0.37 | 0.38 | AA | F | F | | |
| 75 | Comparative Example | 35 | 260 | 0.070 | 0.30 | 0.25 | AA | F | F | | |
| 76 | Comparative Example | 35 | 260 | 0.070 | 0.30 | 0.50 | AA | F | F | | |
| 77 | Comparative Example | 35 | 260 | 0.055 | 0.30 | 0.38 | AA | F | F | | |
| 78 | Comparative Example | 35 | 260 | 0.095 | 0.30 | 0.38 | F | AA | F | | |

TABLE 13

| No. | Type | Molten steel discharge angle of immersion nozzle (°) | Immersion depth of immersion nozzle (mm) | Strength of AC magnetic field (T) | Strength of DC magnetic field (T) Upper magnetic poles | Strength of DC magnetic field (T) Lower magnetic poles | Defects originating from steel making Flux defects | Defects originating from steel making Bubble defects | Defects after Zn plating | Other casting conditions Casting speed (m/min) | Other casting conditions Slab width (mm) |
|---|---|---|---|---|---|---|---|---|---|---|---|
| 79 | Invention Example | 35 | 290 | 0.070 | 0.02 | 0.38 | A | AA | A | 1.00 to 1.20 | 1000 to 1400 |
| 80 | Invention Example | 35 | 290 | 0.070 | 0.12 | 0.38 | AA | AA | AA | | |
| 81 | Invention Example | 35 | 290 | 0.070 | 0.18 | 0.38 | AA | A | A | | |
| 82 | Invention Example | 35 | 290 | 0.070 | 0.12 | 0.30 | AA | A | A | | |
| 83 | Invention Example | 35 | 290 | 0.070 | 0.12 | 0.45 | AA | A | A | | |
| 84 | Invention Example | 35 | 290 | 0.060 | 0.12 | 0.38 | AA | A | A | | |
| 85 | Invention Example | 35 | 290 | 0.090 | 0.12 | 0.38 | A | AA | A | | |
| 86 | Comparative Example | 35 | 290 | 0.090 | 0.01 | 0.38 | F | AA | F | | |
| 87 | Comparative Example | 35 | 290 | 0.070 | 0.19 | 0.38 | A | F | F | | |
| 88 | Comparative Example | 35 | 290 | 0.070 | 0.12 | 0.25 | AA | F | F | | |
| 89 | Comparative Example | 35 | 290 | 0.070 | 0.12 | 0.50 | AA | F | F | | |
| 90 | Comparative Example | 35 | 290 | 0.055 | 0.12 | 0.38 | AA | F | F | | |
| 91 | Comparative Example | 35 | 290 | 0.095 | 0.12 | 0.38 | F | AA | F | | |
| 92 | Invention Example | 35 | 290 | 0.070 | 0.19 | 0.38 | A | AA | A | 1.60 to 1.80 | 1100 to 1300 |
| 93 | Invention Example | 35 | 290 | 0.070 | 0.22 | 0.38 | AA | AA | AA | | |
| 94 | Invention Example | 35 | 290 | 0.070 | 0.25 | 0.38 | AA | A | A | | |
| 95 | Invention Example | 35 | 290 | 0.070 | 0.22 | 0.30 | AA | A | A | | |
| 96 | Invention Example | 35 | 290 | 0.070 | 0.22 | 0.45 | AA | A | A | | |
| 97 | Invention Example | 35 | 290 | 0.060 | 0.22 | 0.38 | AA | A | A | | |
| 98 | Invention Example | 35 | 290 | 0.090 | 0.22 | 0.38 | A | AA | A | | |
| 99 | Comparative Example | 35 | 290 | 0.070 | 0.17 | 0.38 | F | AA | F | | |
| 100 | Comparative Example | 35 | 290 | 0.070 | 0.27 | 0.38 | AA | F | F | | |
| 101 | Comparative Example | 35 | 290 | 0.070 | 0.22 | 0.25 | AA | F | F | | |
| 102 | Comparative Example | 35 | 290 | 0.070 | 0.22 | 0.50 | AA | F | F | | |
| 103 | Comparative Example | 35 | 290 | 0.055 | 0.22 | 0.38 | AA | F | F | | |
| 104 | Comparative Example | 35 | 290 | 0.095 | 0.22 | 0.38 | F | AA | F | | |

TABLE 14

| No. | Type | Molten steel discharge angle of immersion nozzle (°) | Immersion depth of immersion nozzle (mm) | Strength of AC magnetic field (T) | Strength of DC magnetic field (T) Upper magnetic poles | Strength of DC magnetic field (T) Lower magnetic poles | Defects originating from steel making Flux defects | Defects originating from steel making Bubble defects | Defects after Zn plating | Other casting conditions Casting speed (m/min) | Other casting conditions Slab width (mm) |
|---|---|---|---|---|---|---|---|---|---|---|---|
| 105 | Invention Example | 35 | 290 | 0.070 | 0.26 | 0.38 | A | AA | A | 2.10 to 2.20 | 1400 to 1600 |
| 106 | Invention Example | 35 | 290 | 0.070 | 0.30 | 0.38 | AA | AA | AA | | |
| 107 | Invention Example | 35 | 290 | 0.070 | 0.35 | 0.38 | AA | A | A | | |
| 108 | Invention Example | 35 | 290 | 0.070 | 0.30 | 0.30 | AA | A | A | | |
| 109 | Invention Example | 35 | 290 | 0.070 | 0.30 | 0.45 | AA | A | A | | |
| 110 | Invention Example | 35 | 290 | 0.060 | 0.30 | 0.38 | AA | A | A | | |
| 111 | Invention Example | 35 | 290 | 0.090 | 0.30 | 0.38 | A | AA | A | | |
| 112 | Comparative Example | 35 | 290 | 0.070 | 0.24 | 0.38 | F | AA | F | | |
| 113 | Comparative Example | 35 | 290 | 0.070 | 0.37 | 0.38 | AA | F | F | | |
| 114 | Comparative Example | 35 | 290 | 0.070 | 0.30 | 0.25 | AA | F | F | | |
| 115 | Comparative Example | 35 | 290 | 0.070 | 0.30 | 0.50 | AA | F | F | | |
| 116 | Comparative Example | 35 | 290 | 0.055 | 0.30 | 0.38 | AA | F | F | | |
| 117 | Comparative Example | 35 | 290 | 0.095 | 0.30 | 0.38 | F | AA | F | | |

Example 11

Continuous casting was conducted under conditions shown in Table 15. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects, and flux defects and bubble defects were identified from among the defects on the basis of the defect form (defect appearance), SEM analysis, ICP analysis, etc. Evaluation was conducted by the standard below on the basis of the number of defects per 100 m of the coil length.

AA: The number of defects was 0.30 or less.

A: The number of defects was more than 0.30 and 1.00 or less.

F: The number of defects was more than 1.00.

On the basis of these results, the "defects after Zn plating" were comprehensively evaluated as follows.

A: Flux defects and bubble defects were rated AA or A.

F: At least one of flux defects and bubble defects was rated F.

The results are also shown in Table 15.

TABLE 15

| No. | Type | Molten steel discharge angle of immersion nozzle (°) | Immersion depth of immersion nozzle (mm) | Strength of AC magnetic field (T) | Strength of DC magnetic field (T) Upper magnetic poles | Strength of DC magnetic field (T) Lower magnetic poles | Defects originating from steel making Flux defects | Defects originating from steel making Bubble defects | Defects after Zn plating | Other casting conditions Casting speed (m/min) | Other casting conditions Slab width (mm) |
|---|---|---|---|---|---|---|---|---|---|---|---|
| 1 | Invention Example | 35 | 180 | 0.070 | 0.12 | 0.38 | A | AA | A | 1.00 to 1.20 | 1000 to 1400 |
| 2 | Invention Example | 35 | 235 | 0.070 | 0.12 | 0.38 | AA | A | A | | |
| 3 | Invention Example | 35 | 240 | 0.070 | 0.12 | 0.38 | A | AA | A | | |
| 4 | Invention Example | 35 | 265 | 0.070 | 0.12 | 0.38 | AA | A | A | | |
| 5 | Invention Example | 35 | 270 | 0.070 | 0.12 | 0.38 | A | AA | A | | |
| 6 | Invention Example | 35 | 295 | 0.070 | 0.12 | 0.38 | AA | A | A | | |
| 7 | Comparative Example | 35 | 170 | 0.070 | 0.12 | 0.38 | F | AA | F | | |
| 8 | Comparative Example | 35 | 310 | 0.070 | 0.12 | 0.38 | AA | F | F | | |
| 9 | Invention Example | 35 | 180 | 0.070 | 0.23 | 0.38 | A | AA | A | 1.60 to 1.80 | 1100 to 1400 |
| 10 | Invention Example | 35 | 230 | 0.070 | 0.23 | 0.38 | AA | A | A | | |
| 11 | Invention Example | 35 | 240 | 0.070 | 0.23 | 0.38 | A | AA | A | | |
| 12 | Invention Example | 35 | 265 | 0.070 | 0.23 | 0.38 | AA | A | A | | |
| 13 | Invention Example | 35 | 270 | 0.070 | 0.23 | 0.38 | A | AA | A | | |
| 14 | Invention Example | 35 | 295 | 0.070 | 0.23 | 0.38 | AA | A | A | | |
| 15 | Comparative Example | 35 | 170 | 0.070 | 0.23 | 0.38 | F | AA | F | | |
| 16 | Comparative Example | 35 | 310 | 0.070 | 0.23 | 0.38 | AA | F | F | | |
| 17 | Invention Example | 35 | 180 | 0.070 | 0.30 | 0.38 | A | AA | A | 2.30 to 2.40 | 1200 to 1400 |
| 18 | Invention Example | 35 | 230 | 0.070 | 0.30 | 0.38 | AA | A | A | | |
| 19 | Invention Example | 35 | 240 | 0.070 | 0.30 | 0.38 | A | AA | A | | |
| 20 | Invention Example | 35 | 265 | 0.070 | 0.30 | 0.38 | AA | A | A | | |
| 21 | Invention Example | 35 | 270 | 0.070 | 0.30 | 0.38 | A | AA | A | | |
| 22 | Invention Example | 35 | 295 | 0.070 | 0.30 | 0.38 | AA | A | A | | |
| 23 | Comparative Example | 35 | 170 | 0.070 | 0.30 | 0.38 | F | AA | F | | |
| 24 | Comparative Example | 35 | 310 | 0.070 | 0.30 | 0.38 | AA | F | F | | |

Example 12

Continuous casting was conducted under casting conditions shown in Tables 16 to 18. The slab formed by such continuous casting was hot-rolled and cold-rolled to prepare a steel sheet and the steel sheet was subjected to a galvannealing treatment. The galvannealed steel sheet was analyzed with an on-line surface defect meter to continuously measure surface defects, and flux defects and bubble defects were identified from among the defects on the basis of the defect form (defect appearance), SEM analysis, ICP analysis, etc. Evaluation was conducted for each of the flux defects and bubble defects by the standard below on the basis of the number of defects per 100 m of the coil length.

AA: The number of defects was 0.30 or less.

A: The number of defects was more than 0.30 and 1.00 or less.

On the basis of these results, the "defects after Zn plating" were comprehensively evaluated as follows. The results are also shown in Tables. 16 to 18.

AA: Both flux defects and bubble defects were rated AA.

A: One of flux defects and bubble defects was rated AA and the other was rated A.

TABLE 16

| No. | Type | Molten steel discharge angle of immersion nozzle (°) | Immersion depth of immersion nozzle (mm) | Frequency of AC magnetic field (Hz) | Strength of AC magnetic field (T) | Strength of DC magnetic field (T) Upper magnetic poles | Strength of DC magnetic field (T) Lower magnetic poles | Defects after Zn plating | Other casting conditions Casting speed (m/min) | Other casting conditions Slab width (mm) |
|---|---|---|---|---|---|---|---|---|---|---|
| 1 | Invention Example | 35 | 230 | 1.5 | 0.070 | 0.12 | 0.38 | AA | 1.00 to 1.20 | 1000 to 1400 |
| 2 | Invention Example | 35 | 230 | 3.5 | 0.070 | 0.12 | 0.38 | AA | | |
| 3 | Invention Example | 35 | 230 | 5.0 | 0.070 | 0.12 | 0.38 | AA | | |
| 4 | Invention Example | 35 | 230 | 1.0 | 0.070 | 0.12 | 0.38 | A | | |
| 5 | Invention Example | 35 | 230 | 6.0 | 0.070 | 0.12 | 0.38 | A | | |
| 6 | Invention Example | 35 | 260 | 1.5 | 0.070 | 0.12 | 0.38 | AA | | |
| 7 | Invention Example | 35 | 260 | 3.5 | 0.070 | 0.12 | 0.38 | AA | | |
| 8 | Invention Example | 35 | 260 | 5.0 | 0.070 | 0.12 | 0.38 | AA | | |
| 9 | Invention Example | 35 | 260 | 1.0 | 0.070 | 0.12 | 0.38 | A | | |
| 10 | Invention Example | 35 | 260 | 6.0 | 0.070 | 0.12 | 0.38 | A | | |
| 11 | Invention Example | 35 | 290 | 1.5 | 0.070 | 0.12 | 0.38 | AA | | |
| 12 | Invention Example | 35 | 290 | 3.5 | 0.070 | 0.12 | 0.38 | AA | | |
| 13 | Invention Example | 35 | 290 | 5.0 | 0.070 | 0.12 | 0.38 | AA | | |
| 14 | Invention Example | 35 | 290 | 1.0 | 0.070 | 0.12 | 0.38 | A | | |
| 15 | Invention Example | 35 | 290 | 6.0 | 0.070 | 0.12 | 0.38 | A | | |

TABLE 17

| No. | Type | Molten steel discharge angle of immersion nozzle (°) | Immersion depth of immersion nozzle (mm) | Frequency of AC magnetic field (Hz) | Strength of AC magnetic field (T) | Strength of DC magnetic field (T) Upper magnetic poles | Strength of DC magnetic field (T) Lower magnetic poles | Defects after Zn plating | Other casting conditions Casting speed (m/min) | Other casting conditions Slab width (mm) |
|---|---|---|---|---|---|---|---|---|---|---|
| 1 | Invention Example | 35 | 230 | 1.5 | 0.070 | 0.23 | 0.38 | AA | 1.60 to 1.80 | 1100 to 1400 |
| 2 | Invention Example | 35 | 230 | 3.5 | 0.070 | 0.23 | 0.38 | AA | | |
| 3 | Invention Example | 35 | 230 | 5.0 | 0.070 | 0.23 | 0.38 | AA | | |
| 4 | Invention Example | 35 | 230 | 1.0 | 0.070 | 0.23 | 0.38 | A | | |
| 5 | Invention Example | 35 | 230 | 6.0 | 0.070 | 0.23 | 0.38 | A | | |
| 6 | Invention Example | 35 | 260 | 1.5 | 0.070 | 0.23 | 0.38 | AA | | |
| 7 | Invention Example | 35 | 260 | 3.5 | 0.070 | 0.23 | 0.38 | AA | | |
| 8 | Invention Example | 35 | 260 | 5.0 | 0.070 | 0.23 | 0.38 | AA | | |
| 9 | Invention Example | 35 | 260 | 1.0 | 0.070 | 0.23 | 0.38 | A | | |
| 10 | Invention Example | 35 | 260 | 6.0 | 0.070 | 0.23 | 0.38 | A | | |
| 11 | Invention Example | 35 | 290 | 1.5 | 0.070 | 0.23 | 0.38 | AA | | |
| 12 | Invention Example | 35 | 290 | 3.5 | 0.070 | 0.23 | 0.38 | AA | | |
| 13 | Invention Example | 35 | 290 | 5.0 | 0.070 | 0.23 | 0.38 | AA | | |
| 14 | Invention Example | 35 | 290 | 1.0 | 0.070 | 0.23 | 0.38 | A | | |
| 15 | Invention Example | 35 | 290 | 6.0 | 0.070 | 0.23 | 0.38 | A | | |

TABLE 18

| No. | Type | Molten steel discharge angle of immersion nozzle (°) | Immersion depth of immersion nozzle (mm) | Frequency of AC magnetic field (Hz) | Strength of AC magnetic field (T) | Strength of DC magnetic field (T) Upper magnetic poles | Strength of DC magnetic field (T) Lower magnetic poles | Defects after Zn plating | Other casting conditions Casting speed (m/min) | Other casting conditions Slab width (mm) |
|---|---|---|---|---|---|---|---|---|---|---|
| 16 | Invention Example | 35 | 230 | 1.5 | 0.070 | 0.30 | 0.38 | AA | 2.25 to 2.40 | 1200 to 1400 |
| 17 | Invention Example | 35 | 230 | 3.5 | 0.070 | 0.30 | 0.38 | AA | | |
| 18 | Invention Example | 35 | 230 | 5.0 | 0.070 | 0.30 | 0.38 | AA | | |
| 19 | Invention Example | 35 | 230 | 1.0 | 0.070 | 0.30 | 0.38 | A | | |
| 20 | Invention Example | 35 | 230 | 6.0 | 0.070 | 0.30 | 0.38 | A | | |
| 21 | Invention Example | 35 | 260 | 1.5 | 0.070 | 0.30 | 0.38 | AA | | |
| 22 | Invention Example | 35 | 260 | 3.5 | 0.070 | 0.30 | 0.38 | AA | | |
| 23 | Invention Example | 35 | 260 | 5.0 | 0.070 | 0.30 | 0.38 | AA | | |
| 24 | Invention Example | 35 | 260 | 1.0 | 0.070 | 0.30 | 0.38 | A | | |
| 25 | Invention Example | 35 | 260 | 6.0 | 0.070 | 0.30 | 0.38 | A | | |
| 26 | Invention Example | 35 | 290 | 1.5 | 0.070 | 0.30 | 0.38 | AA | | |
| 27 | Invention Example | 35 | 290 | 3.5 | 0.070 | 0.30 | 0.38 | AA | | |
| 28 | Invention Example | 35 | 290 | 5.0 | 0.070 | 0.30 | 0.38 | AA | | |
| 29 | Invention Example | 35 | 290 | 1.0 | 0.070 | 0.30 | 0.38 | A | | |
| 30 | Invention Example | 35 | 290 | 6.0 | 0.070 | 0.30 | 0.38 | A | | |

According to the present invention, the problems of the related art can be addressed and a high-quality cast slab that has not only very few defects originating from non-metallic inclusions and mold flux which have conventionally been regarded as problems but also very few defects related to fine bubbles and entrapment of mold flux which have not been regarded as problems hitherto can be obtained by controlling the molten steel flow in a mold by using electromagnetic force. Accordingly, for example, a galvannealed steel sheet having a high-quality coating layer not known in the related art can be produced. Moreover, since the system for controlling an AD magnetic field is not needed, the control system of a magnetic field generator can be simplified and the facility cost can be greatly reduced.

REFERENCE NUMBERS LIST

1 Mold
2 Immersion nozzle
3*a*, 3*b* Upper magnetic pole
4*a*, 4*b* Lower magnetic pole
5 Solidification shell
6 Meniscus
10 Mold long side portion
11 Mold short side portion
21 Immersion nozzle bottom
20 Molten steel spout
30*a*, 30*b* AC magnetic field magnetic pole
31*a*, 31*b* DC magnetic field magnetic pole

The invention claimed is:

1. A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, wherein the immersion nozzle is used at an immersion depth (distance from a meniscus to an upper end of the molten steel spout) of 180 mm or more and less than 240 mm, a strength of the AC magnetic field applied to the upper magnetic poles is set to 0.060 to 0.090 T, a strength of a DC magnetic field applied to the upper magnetic poles is set to 0.02 to 0.18 T, a strength of a DC magnetic field applied to the lower magnetic poles is set to 0.30 to 0.45 T, and continuous casting is conducted at casting speeds (a) to (d) below:

(a) when a slab width is 950 mm or more and less than 1050 mm, the casting speed is 0.95 m/min or more and less than 1.65 m/min;

(b) when a slab width is 1050 mm or more and less than 1250 mm, the casting speed is 0.95 m/min or more and less than 1.45 m/min;

(c) when a slab width is 1250 mm or more and less than 1450 mm, the casting speed is 0.95 m/min or more and less than 1.25 m/min; and (d) when a slab width is 1450 mm or more and less than 1750 mm, the casting speed is 0.95 m/min or more and less than 1.05 m/min.

2. A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, wherein the immersion nozzle is used at an immersion depth (distance from a meniscus to an upper end of the molten steel spout) of 180 mm or more and less than 240 mm, a strength of the AC magnetic field applied to the upper magnetic poles is set to 0.060 to 0.090 T, a strength of a DC magnetic field applied to the upper magnetic poles is set to more than 0.18 T and 0.25 T or less, a strength of a DC magnetic field applied to the lower magnetic poles is set to 0.30 to 0.45 T, and continuous casting is conducted at casting speeds (a) to (e) below:

(a) when a slab width is 1050 mm or more and less than 1150 mm, the casting speed is 1.45 m/min or more and less than 2.25 m/min;

(b) when a slab width is 1150 mm or more and less than 1250 mm, the casting speed is 1.45 m/min or more and less than 2.05 m/min;

(c) when a slab width is 1250 mm or more and less than 1350 mm, the casting speed is 1.25 m/min or more and less than 2.05 m/min;

(d) when a slab width is 1350 mm or more and less than 1450 mm, the casting speed is 1.25 m/min or more and less than 1.85 m/min; and (e) when a slab width is 1450 mm or more and less than 1750 mm, the casting speed is 1.05 m/min or more and less than 1.65 m/min.

3. A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, wherein the immersion nozzle is used at an immersion depth (distance from a meniscus to an upper end of the molten steel spout) of 180 mm or more and less than 240 mm, a strength of the AC magnetic field applied to the upper magnetic poles is set to 0.060 to 0.090 T, a strength of a DC magnetic field applied to the upper magnetic poles is set to more than 0.25 T and 0.35 T or less, a strength of a DC magnetic field applied to the lower magnetic poles is set to 0.30 to 0.45 T, and continuous casting is conducted at casting speeds (a) to (f) below:

(a) when a slab width is 1050 mm or more and less than 1150 mm, the casting speed is 2.25 m/min or more and less than 2.65 m/min;

(b) when a slab width is 1150 mm or more and less than 1350 mm, the casting speed is 2.05 m/min or more and less than 2.65 m/min;

(c) when a slab width is 1350 mm or more and less than 1450 mm, the casting speed is 1.85 m/min or more and less than 2.45 m/min;

(d) when a slab width is 1450 mm or more and less than 1550 mm, the casting speed is 1.65 m/min or more and less than 2.35 m/min;

(e) when a slab width is 1550 mm or more and less than 1650 mm, the casting speed is 1.65 m/min or more and less than 2.25 m/min; and (f) when a slab width is 1650 mm or more and less than 1750 mm, the casting speed is 1.65 m/min or more and less than 2.15 m/min.

4. A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, wherein the immersion nozzle is used at an immersion depth (distance from a meniscus to an upper end of the molten steel spout) of 240 mm or more and less than 270 mm, a strength of the AC magnetic field applied to the upper magnetic poles is set to 0.060 to 0.090 T, a strength of a DC magnetic field applied to the upper magnetic poles is set to 0.02 to 0.18 T, a strength of a DC magnetic field applied to the lower magnetic poles is set to 0.30 to 0.45 T, and continuous casting is conducted at casting speeds (a) to (d) below:

(a) when a slab width is 950 mm or more and less than 1050 mm, the casting speed is 0.95 m/min or more and less than 1.65 m/min;

(b) when a slab width is 1050 mm or more and less than 1250 mm, the casting speed is 0.95 m/min or more and less than 1.45 m/min;

(c) when a slab width is 1250 mm or more and less than 1450 mm, the casting speed is 0.95 m/min or more and less than 1.25 m/min; and (d) when a slab width is 1450 mm or more and less than 1750 mm, the casting speed is 0.95 m/min or more and less than 1.05 m/min.

5. A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, wherein the immersion nozzle is used at an immersion depth (distance from a meniscus to an upper end of the molten steel spout) of 240 mm or more and less than 270 mm, a strength of the AC magnetic field applied to the upper magnetic poles is set to 0.060 to 0.090 T, a strength of a DC magnetic field applied to the upper magnetic poles is set to more than 0.18 T and 0.25 T or less, a strength of a DC magnetic field applied to the lower magnetic poles is set to 0.30 to 0.45 T, and continuous casting is conducted at casting speeds (a) to (f) below:

(a) when a slab width is 1050 mm or more and less than 1150 mm, the casting speed is 1.45 m/min or more and less than 2.45 m/min;

(b) when a slab width is 1150 mm or more and less than 1250 mm, the casting speed is 1.45 m/min or more and less than 2.25 m/min;

(c) when a slab width is 1250 mm or more and less than 1350 mm, the casting speed is 1.25 m/min or more and less than 2.05 m/min;

(d) when a slab width is 1350 mm or more and less than 1450 mm, the casting speed is 1.25 m/min or more and less than 1.85 m/min;

(e) when a slab width is 1450 mm or more and less than 1550 mm, the casting speed is 1.05 m/min or more and less than 1.85 m/min; and (f) when a slab width is 1550 mm or more and less than 1750 mm, the casting speed is 1.05 m/min or more and less than 1.65 m/min.

6. A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, wherein the immersion nozzle is used at an immersion depth (distance from a meniscus to an upper end of the molten steel spout) of 240 mm or more and less than 270 mm, a strength of the AC magnetic field applied to the upper magnetic poles is set to 0.060 to 0.090 T, a strength of a DC magnetic field applied to the upper magnetic poles is set to more than 0.25 T and 0.35 T or less, a strength of a DC magnetic field applied to the lower magnetic poles is set to 0.30 to 0.45 T, and continuous casting is conducted at casting speeds (a) to (g) below:

(a) when a slab width is 1050 mm or more and less than 1150 mm, the casting speed is 2.45 m/min or more and less than 2.65 m/min;

(b) when a slab width is 1150 mm or more and less than 1250 mm, the casting speed is 2.25 m/min or more and less than 2.65 m/min;

(c) when a slab width is 1250 mm or more and less than 1350 mm, the casting speed is 2.05 m/min or more and less than 2.65 m/min;

(d) when a slab width is 1350 mm or more and less than 1450 mm, the casting speed is 1.85 m/min or more and less than 2.45 m/min;

(e) when a slab width is 1450 mm or more and less than 1550 mm, the casting speed is 1.85 m/min or more and less than 2.35 m/min;

(f) when a slab width is 1550 mm or more and less than 1650 mm, the casting speed is 1.65 m/min or more and less than 2.25 m/min; and (g) when a slab width is 1650 mm or more and less than 1750 mm, the casting speed is 1.65 m/min or more and less than 2.15 m/min.

7. A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, wherein the immersion nozzle is used at an immersion depth (distance from a meniscus to an upper end of the molten steel spout) of 270 mm or more and less than 300 mm, a strength of the AC magnetic field applied to the upper magnetic poles is set to 0.060 to 0.090 T, a strength of a DC magnetic field applied to the upper magnetic poles is set to 0.02 to 0.18 T, a strength of a DC magnetic field applied to the lower magnetic poles is set to 0.30 to 0.45 T, and continuous casting is conducted at casting speeds (a) to (d) below:

(a) when a slab width is 950 mm or more and less than 1050 mm, the casting speed is 0.95 m/min or more and less than 1.65 m/min;

(b) when a slab width is 1050 mm or more and less than 1250 mm, the casting speed is 0.95 m/min or more and less than 1.45 m/min;

(c) when a slab width is 1250 mm or more and less than 1450 mm, the casting speed is 0.95 m/min or more and less than 1.25 m/min; and (d) when a slab width is 1450 mm or more and less than 1750 mm, the casting speed is 0.95 m/min or more and less than 1.05 m/min.

8. A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, wherein the immersion nozzle is used at an immersion depth (distance from a meniscus to an upper end of the molten steel spout) of 270 mm or more and less than 300 mm, a strength of the AC magnetic field applied to the upper magnetic poles is set to 0.060 to 0.090 T, a strength of a DC magnetic field applied to the upper magnetic poles is set to more than 0.18 T and 0.25 T or less, a strength of a DC magnetic field applied to the lower magnetic poles is set to 0.30 to 0.45 T, and continuous casting is conducted at casting speeds (a) to (f) below:

(a) when a slab width is 1050 mm or more and less than 1150 mm, the casting speed is 1.45 m/min or more and less than 2.65 m/min;

(b) when a slab width is 1150 mm or more and less than 1250 mm, the casting speed is 1.45 m/min or more and less than 2.25 m/min;

(c) when a slab width is 1250 mm or more and less than 1350 mm, the casting speed is 1.25 m/min or more and less than 2.25 m/min;

(d) when a slab width is 1350 mm or more and less than 1450 mm, the casting speed is 1.25 m/min or more and less than 2.05 m/min;

(e) when a slab width is 1450 mm or more and less than 1650 mm, the casting speed is 1.05 m/min or more and less than 1.85 m/min; and (f) when a slab width is 1650 mm or more and less than 1750 mm, the casting speed is 1.05 m/min or more and less than 1.65 m/min.

9. A steel continuous casting method using a continuous caster that includes a pair of upper magnetic poles and a pair of lower magnetic poles disposed on outer sides of a mold, the upper magnetic poles facing each other with a mold long side portion therebetween and the lower magnetic poles facing each other with the mold long side portion therebetween, and an immersion nozzle having a molten steel spout located between a peak position of a DC magnetic field of the upper magnetic poles and a peak position of a DC magnetic field of the lower magnetic poles, the method comprising braking a molten steel flow with the DC magnetic fields respectively applied to the pair of upper magnetic poles and the pair of lower magnetic poles while stirring a molten steel with an AC magnetic field simultaneously applied to the pair of upper magnetic poles, wherein the immersion nozzle is used at an immersion depth (distance from a meniscus to an upper end of the molten steel spout) of 270 mm or more and less than 300 mm, a strength of the AC magnetic field applied to the upper magnetic poles is set to 0.060 to 0.090 T, a strength of a DC magnetic field applied to the upper magnetic poles is set to more than 0.25 T and 0.35 T or less, a strength of a DC magnetic field applied to the lower magnetic poles is set to 0.30 to 0.45 T, and continuous casting is conducted at casting speeds (a) to (e) below:

(a) when a slab width is 1150 mm or more and less than 1350 mm, the casting speed is 2.25 m/min or more and less than 2.65 m/min;

(b) when a slab width is 1350 mm or more and less than 1450 mm, the casting speed is 2.05 m/min or more and less than 2.45 m/min;

(c) when a slab width is 1450 mm or more and less than 1550 mm, the casting speed is 1.85 m/min or more and less than 2.35 m/min;

(d) when a slab width is 1550 mm or more and less than 1650 mm, the casting speed is 1.85 m/min or more and less than 2.25 m/min; and (e) when a slab width is 1650 mm or more and less than 1750 mm, the casting speed is 1.65 m/min or more and less than 2.15 m/min.

10. The steel continuous casting method according to any one of claims 1 to 9, wherein the molten steel in the mold has a turbulence energy on top surface: 0.0020 to 0.0035 $m^2/s^2$, a flow velocity on top surface: 0.30 m/s or less, and a flow velocity at a molten steel-solidification shell interface: 0.08 to 0.20 m/s.

* * * * *